US008047011B2

(12) United States Patent
Kawano et al.

(10) Patent No.: US 8,047,011 B2
(45) Date of Patent: Nov. 1, 2011

(54) REFRIGERATION SYSTEM

(75) Inventors: Satoshi Kawano, Osaka (JP); Shinya Matsuoka, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 180 days.

(21) Appl. No.: 12/515,957

(22) PCT Filed: Nov. 28, 2007

(86) PCT No.: PCT/JP2007/072918

§ 371 (c)(1),
(2), (4) Date: May 22, 2009

(87) PCT Pub. No.: WO2008/069066

PCT Pub. Date: Jun. 12, 2008

(65) Prior Publication Data

US 2010/0043467 A1 Feb. 25, 2010

(30) Foreign Application Priority Data

Dec. 4, 2006 (JP) ..... 2006-326474

(51) Int. Cl.
*F25B 13/00* (2006.01)

(52) U.S. Cl. ..... 62/160; 62/238.7

(58) Field of Classification Search ..... 62/129, 62/160, 159, 208, 209, 238.7, 325, 324.1, 62/513

See application file for complete search history.

(56) References Cited

U.S. PATENT DOCUMENTS

| | | | | | |
|---|---|---|---|---|---|
| 4,735,060 | A * | 4/1988 | Alsenz | 62/225 |
| 4,771,610 | A * | 9/1988 | Nakashima et al. | 62/160 |
| 4,833,893 | A * | 5/1989 | Morita | 62/113 |
| 4,841,734 | A * | 6/1989 | Torrence | 62/115 |
| 5,046,325 | A * | 9/1991 | Kuwahara | 62/156 |
| 5,088,646 | A * | 2/1992 | Yamagishi et al. | 237/2 B |
| 5,109,677 | A * | 5/1992 | Phillippe | 62/160 |
| 5,461,876 | A * | 10/1995 | Dressler | 62/160 |
| 5,937,665 | A * | 8/1999 | Kiessel et al. | 62/260 |
| 7,159,409 | B2 * | 1/2007 | Manole | 62/180 |
| 2005/0262859 | A1 * | 12/2005 | Crane et al. | 62/197 |

FOREIGN PATENT DOCUMENTS

| | | | |
|---|---|---|---|
| JP | 4-184051 | A | 7/1992 |
| JP | 5-332630 | A | 12/1993 |
| JP | 11-241844 | A | 9/1999 |
| JP | 2006-250479 | A | 9/2006 |

OTHER PUBLICATIONS

Translation of JP 5-332630 A to Nakayama et al.*

* cited by examiner

*Primary Examiner* — Mohammad Ali
(74) *Attorney, Agent, or Firm* — Birch, Stewart, Kolasch & Birch, LLP.

(57) ABSTRACT

In concurrent operation of performing a refrigeration cycle in which an outdoor heat exchanger (22) functions as a condenser, and at least one of a plurality of indoor heat exchangers (31, 41, 51) functions as a condenser, pressure difference ΔP1 between a high pressure refrigerant an a refrigerant in a liquid pipe (15) is detected, and the degree of opening of an outdoor expansion valve (23) is adjusted so that the pressure difference ΔP1 becomes larger than a predetermined target value.

7 Claims, 13 Drawing Sheets

REFRIGERATION SYSTEM

TECHNICAL FIELD

The present invention relates to a refrigeration system including a refrigerant circuit having a plurality of heat exchangers, particularly to measures to cope with an imbalance in refrigerant flow between the heat exchangers.

BACKGROUND ART

There are known individually controllable refrigeration systems capable of meeting both a heating demand and a cooling demand in rooms at the same time. Such a refrigeration system includes a plurality of heat-using units placed in different rooms, respectively, so that some units perform cooling, and the other units perform heating.

Patent Document 1 discloses a refrigeration system of this kind. As shown in FIG. 12, a refrigeration system (100) includes a refrigerant circuit (101) in which a refrigerant circulates to perform a refrigeration cycle. The refrigerant circuit (101) includes a compressor (102), a heat-source heat exchanger (103), and first and second heat exchangers (first and second heat-using heat exchangers) (104, 105). A heat-source expansion valve (106) is provided near the heat-source heat exchanger (103), and first and second expansion valves (heat-using expansion valves) (107, 108) are provided near the heat-using heat exchangers (104, 105), respectively. The refrigerant circuit (101) further includes two three-way valves (109, 110), and first and second BS units (111, 112). Each of the BS units (111, 112) has two solenoid valves.

This refrigeration system (100) can perform a refrigeration cycle in which, for example, the heat-source heat exchanger (103) and the first heat-using heat exchanger (104) function as condensers, and the second heat-using heat exchanger (105) functions as an evaporator. In operation shown in FIG. 13, a refrigerant discharged from the compressor (102) is divided into two flows. One refrigerant flow condenses in the heat-source heat exchanger (103), passes through the full-open heat-source expansion valve (106), and flows into a liquid pipe (113). The other refrigerant flow passes through the first BS unit (111) and flows into the first heat-using heat exchanger (104). As a result, the refrigerant dissipates heat into indoor air in the first heat-using heat exchanger (104) to heat the room. After passing through the first heat-using expansion valve (107), the refrigerant flows into the liquid pipe (113), and joins with the refrigerant sent to the heat-source heat exchanger (103). The joined refrigerant is reduced in pressure as it passes through the second heat-using expansion valve (108), and then flows into the second heat-using heat exchanger (105). In the second heat-using heat exchanger (105), the refrigerant absorbs heat from the indoor air to cool the room. After that, the refrigerant passes through the second BS unit (112) and is sucked into the compressor (102).

In this manner, the refrigeration system (100) performs the refrigeration cycle by using the heat-using heat exchangers (104, 105) individually as the evaporator or the condenser, so as to allow independently switchable heating/cooling operation that satisfies both of the cooling and heating demands in the rooms at the same time.

Patent Document 1: Published Japanese Patent Application No. H11-241844

DISCLOSURE OF THE INVENTION

Problem that the Invention is to Solve

In the above-described refrigeration system (100), however, during operation (concurrent operation) of performing a refrigeration cycle in which the heat-source heat exchanger (103) functions as a condenser, and at least one heat-using heat exchanger (104) functions as a condenser, heating capability of the heat-using heat exchanger (104) may deteriorate due to an imbalance in refrigerant flow. This phenomenon will be described below with reference to FIG. 13.

In operation shown in FIG. 13, the degree of opening of the first heat-using expansion valve (107) is suitably adjusted to adjust the heating capability of the first heat-using heat exchanger (104). Therefore, for example, when the heating capability of the first heat-using heat exchanger (104) is insufficient, the degree of opening of the first heat-using expansion valve (107) is increased so that a larger amount of the refrigerant flows into the first heat-using heat exchanger (104). However, increasing the degree of opening of the first heat-using expansion valve (107) reduces pressure difference between a high pressure refrigerant on the discharge side of the compressor (102) and a refrigerant in the liquid pipe (113). Then, due to the reduced pressure difference between the high pressure refrigerant and the refrigerant in the liquid pipe (113), the refrigerant flows primarily into the heat-source heat exchanger (103), and therefore the amount of the refrigerant sent to the first heat-using heat exchanger (104) becomes insufficient. In particular, since a flow path from the compressor (102) to the first heat-using heat exchanger (104) is relatively long, pressure loss in the pipe constituting this flow path is also increased. Therefore, under these conditions, the pressure difference between the refrigerant flowing into the first heat-using heat exchanger (104) and the refrigerant flowing out of the first heat-using heat exchanger (104) is reduced, and a sufficient amount of the refrigerant cannot be supplied to the first heat-using heat exchanger (104).

For the above-described reason, this refrigeration system may experience imbalance in refrigerant flow between the heat-source heat exchanger (103) and the heat-using heat exchangers (104, 105). As a result, in the refrigeration system of this kind, the amount of the refrigerant flowing into the heat exchanger may become insufficient due to the imbalance in refrigerant flow, and operation cannot be performed with reliability.

In view of the foregoing, the present invention was developed. The present invention is directed to a refrigeration system capable of performing a refrigeration cycle in which a heat-source heat exchanger functions as a condenser, and at least one of the other heat exchangers functions as a condenser, and the invention aims to prevent the imbalance in refrigerant flow between the heat exchangers.

Means of Solving the Problem

A first aspect of the invention is directed to a refrigeration system including: a refrigerant circuit (10) including a compressor (21), a heat-source heat exchanger (22) connected to a discharge side of the compressor (21) at one end thereof, a liquid pipe (15) connected to the other end of the heat-source heat exchanger (22) through a heat-source expansion valve (23), a plurality of heat exchangers (31, 41, 51, 92) connected in parallel to the liquid pipe (15) at one ends thereof, a plurality of expansion valves (32, 42, 52, 93), each of which is provided on one end of the corresponding heat exchanger (31, 41, 51, 92) to adjust an amount of a refrigerant flowing to the corresponding heat exchanger (31, 41, 51, 92), and a switching mechanism (24, 25, SV) which switches a flow path of the refrigerant so that the other ends of the heat exchangers (31, 41, 51, 92) are connected to one of a suction side and a discharge side of the compressor (21). The refrigeration system includes a high-pressure-side pressure difference detection means (Ps1, Ps3, Ts7) which detects an index of pressure difference between a high pressure refrigerant on the discharge side of the compressor (21) and a refrigerant in the liquid pipe (15) in concurrent operation of performing a refrigeration cycle in which the heat-source heat exchanger (22) functions as a condenser, and simultaneously, at least one of the plurality of heat exchangers (31, 41, 51, 92) functions as a condenser, and at least one of the plurality of heat exchangers (31, 41, 51, 92) functions as an evaporator, and an expansion valve control means (17) which adjusts the degree of opening of the heat-source expansion valve (23) in the concurrent operation so that a value detected by the high-pressure-side pressure difference detection means (Ps1, Ps3, Ts7) becomes larger than a predetermined value.

The refrigeration system according to the first aspect of the invention allows concurrent operation of performing a refrigeration cycle in which the heat-source heat exchanger (22) functions as a condenser, at least one of the other heat exchangers (31, 41, 51, 92) functions as a condenser, and at least one of the other heat exchangers (31, 41, 51, 92) functions as an evaporator. In this concurrent operation, the other end of the first heat exchanger serving as a condenser is connected to the discharge side of the compressor (21), and the other end of the second heat exchanger serving as an evaporator is connected to the suction side of the compressor (21) by switching the setting of the switching mechanism (24, 25, SV). In this state, the refrigerant discharged from the compressor (21) is divided to flow into the heat-source heat exchanger (22) and the first heat exchanger. The refrigerant condensed in the heat-source heat exchanger (22) passes through the heat-source expansion valve (23), and flows into the liquid pipe (15). On the other hand, the refrigerant condensed in the first heat exchanger passes through the corresponding first expansion valve, and flows into the liquid pipe (15). The refrigerants are joined into one in the liquid pipe (15) and reduced in pressure by the second expansion valve corresponding to the second heat exchanger, and evaporates in the second heat exchanger. The refrigerant evaporated in the second heat exchanger is then sucked into the compressor (21) for recompression.

In this concurrent operation, the degree of opening of the first expansion valve is adjusted to control the amount of heat dissipation by the refrigerant in the first heat exchanger. When the degree of opening of the first expansion valve is increased too much for increasing the amount of heat dissipation, pressure difference between the high pressure refrigerant on the discharge side of the compressor (21) and the refrigerant in the liquid pipe (15) is reduced. Therefore, the refrigerant primarily flows into the heat-source heat exchanger (22), and the amount of the refrigerant sent to the first heat exchanger may become insufficient.

In view of the foregoing, according to the first aspect of the invention, the high-pressure-side pressure difference detection means (Ps1, Ps3, Ts7) obtains an index of pressure difference between the high pressure refrigerant and the refrigerant in the liquid pipe (15) in the concurrent operation. Then, the expansion valve control means (17) adjusts the degree of opening of the heat-source expansion valve (23) so that the index of pressure difference becomes larger than a predetermined value, thereby maintaining the pressure difference at a certain value or higher. Specifically, when the pressure difference between the high pressure refrigerant and the refrigerant in the liquid pipe (15) is reduced in the above-described manner, and for example, the amount of the refrigerant in the first heat exchanger becomes insufficient, the expansion valve control means (17) reduces the degree of opening of the heat-source expansion valve (23). This reduces the pressure of the refrigerant downstream of the heat-source expansion valve (23), i.e., the refrigerant in the liquid pipe (15), and therefore increases the pressure difference between the high pressure refrigerant and the refrigerant in the liquid pipe (15). The increase in pressure difference between the high pressure refrigerant and the refrigerant in the liquid pipe ensures the pressure difference which allows the refrigerant to flow sufficiently into the first heat exchanger. As a result, a larger amount of the refrigerant flows into the first heat exchanger. Thus, the present invention can prevent the lack of the refrigerant flowing into the heat exchanger serving as a condenser due to the imbalance in refrigerant flow.

In a second aspect of the invention, the refrigerant circuit (10) in the refrigeration system according to the first aspect of the invention includes three or more heat exchangers (31, 41, 51, 92) connected in parallel to the liquid pipe (15), and a low-pressure-side pressure difference detection means (Ps2, Ps3, Ts1, Ts3, Ts5) which detects an index of pressure difference between the refrigerant in the liquid pipe (15) and a low pressure refrigerant on the suction side of the compressor (21), and the expansion valve control means (17) adjusts the degree of opening of the heat-source expansion valve (23) so that a value detected by the high-pressure-side pressure difference detection means (Ps1, Ps3, Ts7) becomes larger than a predetermined value, and a value detected by the low-pressure-side pressure difference detection means (Ps2, Ps3, Ts1, Ts3, Ts5) becomes larger than a predetermined value, in the concurrent operation of performing a refrigeration cycle in which the heat-source heat exchanger (22) functions as a condenser, and simultaneously, at least two of the plurality of heat exchangers (31, 41, 51, 92) function as evaporators, and at least one of the plurality of heat exchangers (31, 41, 51, 92) functions as a condenser.

The refrigerant circuit (10) according to the second aspect of the invention includes three or more heat exchangers (31, 41, 51, 92), in addition to the heat-source heat exchanger (22). Therefore, the refrigeration system allows concurrent operation of performing a refrigeration cycle in which the heat-source heat exchanger (22) functions as a condenser, at least two heat exchangers function as evaporators, and at least one heat exchanger functions as a condenser. In this concurrent operation, the other end of the first heat exchanger serving as a condenser is connected to the discharge side of the compressor (21), and the other ends of the second and third heat exchangers serving as evaporators are connected to the suction side of the compressor (21) by switching the setting of the switching mechanism (24, 25, SV). In this state, the refrigerant discharged from the compressor (21) is divided to flow into the heat-source heat exchanger (22) and the first heat exchanger. The refrigerant condensed in the heat-source heat exchanger (22) passes through the heat-source expansion valve (23), and flows into the liquid pipe (15). On the other hand, the refrigerant condensed in the first heat exchanger passes through the corresponding first expansion valve, and flows into the liquid pipe (15). The refrigerants are joined into one in the liquid pipe (15) and divided to flow into the second and third heat exchangers. That is, one divided refrigerant flow is reduced in pressure by the second expansion valve corresponding to the second heat exchanger, and evaporates in the second heat exchanger. The other divided refrigerant flow is reduced in pressure by the third expansion valve corresponding to the third heat exchanger, and evaporates in the third heat exchanger. The refrigerants evaporated in the second and third heat exchangers, respectively, are joined into one, and sucked into the compressor (21) for recompression.

In this concurrent operation, like in the first aspect of the invention, the high-pressure-side pressure difference detection means (Ps1, Ps3, Ts7) obtains pressure difference between the high pressure refrigerant and the refrigerant in the liquid pipe (15), and the degree of opening of the heat-source expansion valve (23) is adjusted so that the pressure difference becomes larger than a predetermined value. Specifically, the degree of opening of the heat-source expansion valve (23) is reduced to maintain a sufficient amount of the refrigerant in the heat exchanger serving as a condenser. When the degree of opening of the heat-source expansion valve (23) is reduced, and the pressure of the refrigerant in the liquid pipe (15) becomes too low, the imbalance in refrigerant flow may occur between the plurality of heat exchangers serving as evaporators.

Specifically, in the above-described concurrent operation, the second and third heat exchangers function as evaporators. Suppose that a pipe connecting the compressor (21) and the third heat exchanger is longer than a pipe connecting the compressor (21) and the second heat exchanger in the refrigeration system, and that the pipe connected to the third heat exchanger experiences higher pressure loss. Under these conditions, when the degree of opening of the heat-source expansion valve (23) is reduced, and the pressure of the refrigerant in the liquid pipe (15) is reduced too much, the refrigerant in the liquid pipe (15) may primarily flow into the second heat exchanger, and therefore the amount of the refrigerant sent to the third heat exchanger may be decreased. As a result, even in the operation condition in which the amount of heat absorption in the third heat exchanger should be maintained to a sufficient degree, the amount of the refrigerant in the third heat exchanger becomes insufficient. Thus, a problem of decrease in reliability of the refrigeration system arises.

To cope with this problem, in the second aspect of the invention, the low-pressure-side pressure difference detection means (Ps2, Ps3, Ts1, Ts3, Ts5) obtains the index of pressure difference between the refrigerant in the liquid pipe (15) and the low pressure refrigerant. Then, the expansion valve control means (17) adjusts the degree of opening of the heat-source expansion valve (23) so that the pressure difference (the index of pressure difference) becomes larger than a predetermined value, and that the above-described pressure difference between the high pressure refrigerant and the refrigerant in the liquid pipe also becomes larger than the predetermined value. Specifically, the expansion valve control means (17) adjusts the degree of opening of the heat-source expansion valve (23) so that the pressure difference between the high pressure refrigerant and the refrigerant in the liquid pipe is maintained at a certain level, and simultaneously, the pressure difference between the refrigerant in the liquid pipe and the low pressure refrigerant is maintained at a sufficient level. This prevents the imbalance in refrigerant flow between the heat-source heat exchanger (22) and the heat exchanger serving as a condenser, like in the first aspect of the invention. In parallel with this, according to the second aspect of the invention, the pressure difference between the refrigerant in the liquid pipe and the low pressure refrigerant is also maintained at a sufficient level. Therefore, a sufficient amount of the refrigerant can be sent to, for example, the third heat exchanger which experiences high pressure loss. Thus, the present invention can prevent the imbalance in refrigerant flow between the plurality of heat exchangers serving as evaporators.

In a third aspect of the invention, the high-pressure-side pressure difference detection means in the refrigeration system according to the first or second aspect of the invention includes a high-pressure-side pressure sensor (Ps1) provided on the discharge side of the compressor (21), and an on-liquid-pipe pressure sensor (Ps3) provided on the liquid pipe (15), and the high-pressure-side pressure difference detection means is configured to detect difference between pressure detected by the high-pressure-side pressure sensor (Ps1) and pressure detected by the on-liquid-pipe pressure sensor (Ps3) as the index of pressure difference between the high pressure refrigerant and the refrigerant in the liquid pipe (15).

In the third aspect of the invention, the high-pressure-side pressure sensor (Ps1) and the on-liquid-pipe pressure sensor (Ps3) are used to obtain the pressure difference between the high pressure refrigerant and the refrigerant in the liquid pipe (15) in the concurrent operation according to the first or second aspect of the invention. Specifically, the high-pressure-side pressure difference detection means (Ps1, Ps3) directly detects the pressure of the high pressure refrigerant and the pressure of the refrigerant in the liquid pipe (15) to obtain the pressure difference between the high pressure refrigerant and the refrigerant in the liquid pipe.

In a fourth aspect of the invention, the high-pressure-side pressure difference detection means in the refrigeration system according to the first or second aspect of the invention includes a condensation temperature detection means (Ps1) which detects condensation temperature of the refrigerant in the heat-source heat exchanger (22) in the concurrent operation, and an on-liquid-pipe temperature sensor (Ts7) provided on the liquid pipe (15), and the high-pressure-side pressure difference detection means is configured to detect difference between temperature detected by the condensation temperature detection means (Ps1) and temperature detected by the on-liquid-pipe temperature sensor (Ts7) as the index of pressure difference between the high pressure refrigerant and the refrigerant in the liquid pipe (15).

In the fourth aspect of the invention, the condensation temperature of the refrigerant in the heat-source heat exchanger (22) and the temperature of the refrigerant in the liquid pipe (15) are used to obtain the pressure difference between the high pressure refrigerant and the refrigerant in the liquid pipe (15) in the concurrent operation according to the first or second aspect of the invention. Specifically, the condensation temperature detection means (Ps1) detects the condensation temperature of the refrigerant in the heat-source heat exchanger (22), and the on-liquid-pipe temperature sensor (Ts7) detects the temperature of the refrigerant that passed through the heat-source expansion valve (23). Since the condensation temperature varies depending on change in pressure of the high pressure refrigerant, it will be an index of the pressure of the high pressure refrigerant. Further, since the temperature of the refrigerant in the liquid pipe (15) also varies depending on change in pressure of the refrigerant in the liquid pipe (15), it will be an index of the pressure of the refrigerant in the liquid pipe (15). Thus, the high-pressure-side pressure difference detection means (Ps1, Ts7) indirectly grasp the pressure difference between the high pressure refrigerant and the refrigerant in the liquid pipe from the difference between the detected temperatures.

In a fifth aspect of the invention, the low-pressure-side pressure difference detection means in the refrigeration system according to the second aspect of the invention includes an on-liquid-pipe pressure sensor (Ps3) provided on the liquid pipe (15), and a low-pressure-side pressure sensor (Ps2) provided on the suction side of the compressor (21), and the low-pressure-side pressure difference detection means is configured to detect difference between pressure detected by the on-liquid-pipe pressure sensor (Ps3) and pressure detected by the low-pressure-side pressure sensor (Ps2) as the index of pressure difference between the refrigerant in the liquid pipe (15) and the low pressure refrigerant.

In the fifth aspect of the invention, the on-liquid-pipe pressure sensor (Ps3) and the low-pressure-side pressure sensor (Ps2) are used to obtain the pressure difference between the refrigerant in the liquid pipe (15) and the low pressure refrigerant in the concurrent operation according to the second aspect of the invention. Specifically, the low-pressure-side pressure difference detection means (Ps3, Ps2) directly detect the pressure of the refrigerant in the liquid pipe (15) and the pressure of the low pressure refrigerant, respectively, to obtain the pressure difference between the refrigerant in the liquid pipe and the low pressure refrigerant.

In a sixth aspect of the invention, the low-pressure-side pressure difference detection means in the refrigeration system according to the second aspect of the invention includes an on-liquid-pipe temperature sensor (Ts7) provided on the liquid pipe (15), and an evaporation temperature detection means (Ts1, Ts3, Ts5) which detects evaporation temperature of the refrigerant in the heat exchanger (31, 41, 51) serving as an evaporator in the concurrent operation, and the low-pressure-side pressure difference detection means is configured to detect difference between temperature detected by the on-liquid-pipe temperature sensor (Ts7) and temperature detected by the evaporation temperature detection means (Ts1, Ts3, Ts5) as the index of pressure difference between the low pressure refrigerant and the refrigerant in the liquid pipe (15).

In the sixth aspect of the invention, the temperature of the refrigerant in the liquid pipe (15) and the evaporation temperature of the refrigerant are used to obtain the pressure difference between the refrigerant in the liquid pipe (15) and the low pressure refrigerant in the concurrent operation according to the second aspect of the invention. Specifically, the on-liquid-pipe temperature sensor (Ts7) detects the temperature of the refrigerant that passed through the heat-source expansion valve (23), and the evaporation temperature detection means (Ts1, Ts3, Ts5) detects the evaporation temperature in the refrigerant in the heat exchanger (31, 41, 51) serving as an evaporator. Since the temperature of the refrigerant in the liquid pipe (15) varies depending on change in pressure of the refrigerant in the liquid pipe (15), it will be an index of the pressure of the refrigerant in the liquid pipe (15). Further, since the evaporation temperature varies depending on change in pressure of the low pressure refrigerant, it will be an index of the pressure of the low pressure refrigerant. Thus, the low-pressure-side pressure difference detection means (Ts7, Ts1, Ts3, Ts5) indirectly grasp the pressure difference between the refrigerant in the liquid pipe and the low pressure refrigerant from the difference between their detected temperatures.

In a seventh aspect of the invention, the liquid pipe (15) in the refrigeration system according to any one of the first to sixth aspects of the invention is provided with a cooling means (28) which cools the refrigerant that passed through the heat-source expansion valve (23) in the concurrent operation.

In the seventh aspect of the invention, the refrigerant reduced in pressure by the heat-source expansion valve (23) is cooled by the cooling means (28) in the concurrent operation. Specifically, in the concurrent operation, when the refrigerant is reduced in pressure by the heat-source expansion valve (23), the refrigerant becomes a vapor-liquid two phase refrigerant. Then, the cooling means (28) subcools the vapor-liquid two phase refrigerant to convert it into a liquid refrigerant. Thus, the liquid refrigerant can be sent to the heat exchanger (31, 41, 51) serving as an evaporator, and noise generated upon passage of the refrigerant through the expansion valve (32, 42, 52) corresponding to the heat exchanger (31, 41, 51) can be reduced.

In an eighth aspect of the invention, the refrigerant circuit (10) in the refrigeration system according to the seventh aspect of the invention includes an injection pipe (19), having a pressure reducing valve (19*a*), which is branched from the liquid pipe (15) and connected to the suction side of the compressor (21), and temperature difference detection means (Ts7, Ts8) which detect temperature difference between the refrigerant flowing into the cooling means (28) and the refrigerant flowing out of the cooling means (28), the cooling means is constituted of a subcooling heat exchanger (28) which allows heat exchange between the refrigerant in the liquid pipe (15) and the refrigerant in the injection pipe (19) that passed through the pressure reducing valve (19*a*), and the refrigeration system includes an injection amount control means (18) which adjusts the degree of opening of the pressure reducing valve (19*a*) in the concurrent operation so that the refrigerant temperature difference detected by the temperature difference detection means (Ts7, Ts8) becomes larger than a predetermined value.

In the eighth aspect of the invention, the subcooling heat exchanger (28) is provided as the cooling means. In the subcooling heat exchanger (28) in the concurrent operation, heat exchange occurs between the refrigerant reduced in pressure by the heat-source expansion valve (23) to become a vapor-liquid two phase refrigerant and passed through the liquid pipe (15), and the refrigerant reduced in pressure by the pressure reducing valve (19*a*) and flows into the injection pipe (19). As a result, the refrigerant in the injection pipe (19) absorbs heat from the refrigerant in the liquid pipe (15) and evaporates, and the refrigerant in the liquid pipe (15) is subcooled. Further, in the present invention, the temperature difference detection means (Ts7, Ts8) detect the temperature difference between the refrigerant flowing into the subcooling heat exchanger (28) and the refrigerant flowing out of the subcooling heat exchanger (28) in the concurrent operation. Then, the injection amount control means (18) adjusts the degree of opening of the pressure reducing valve (19*a*) so that the temperature difference becomes larger than the predetermined value. As a result, the subcooling heat exchanger (28) reliably subcools the refrigerant in the liquid pipe (15) and converts it into a liquid refrigerant. Thus, the liquid refrigerant can reliably be sent to the heat exchanger (31, 41, 51) serving as an evaporator, and noise generated upon passage of the refrigerant through the expansion valve (32, 42, 52) corresponding to the heat exchanger (31, 41, 51) is reduced with reliability.

EFFECT OF THE INVENTION

According to the present invention, the expansion valve control means (17) adjusts the degree of opening of the heat-source expansion valve (23) in the concurrent operation so that the pressure difference between the high pressure refrigerant and the refrigerant in the liquid pipe can be maintained at a sufficient level. Therefore, the present invention allows the prevention of the imbalance in refrigerant flow between the heat-source heat exchanger (22) and the other heat exchangers (31, 41, 51) serving as condensers. This makes it possible to supply a sufficient amount of the refrigerant to the heat exchangers (31, 41, 51). As a result, the amount of heat dissipation by the refrigerant in the heat exchangers (31, 41, 51) can be maintained at a sufficient level. Thus, the heat exchangers (31, 41, 51) can provide sufficient heating capability in heating the rooms.

In the second aspect of the invention, the expansion valve control means (17) adjusts the degree of opening of the heat-source expansion valve (23) in the concurrent operation so as to maintain the pressure difference between the high pressure refrigerant and the refrigerant in the liquid pipe, and maintain the pressure difference between the refrigerant in the liquid pipe and the low pressure refrigerant. Therefore, according the second aspect of the invention, the imbalance in refrigerant flow between the heat-source heat exchanger (22) and the other heat exchangers (31, 41, 51) serving as condensers can be prevented, and simultaneously, the imbalance in refrigerant flow between the other heat exchangers (31, 41, 51, 92) serving as evaporators can also be prevented. Thus, the amount of heat absorption by the refrigerant in the heat exchangers (31, 41, 51, 92) can be maintained at a sufficient level. Thus, the heat exchangers (31, 41, 51) can exhibit sufficient cooling capability in heating the rooms.

In the third aspect of the invention, the pressure difference between the high pressure refrigerant and the refrigerant in the liquid pipe is directly obtained from the difference between the pressures detected by the high-pressure-side pressure sensor (Ps1) and the on-liquid-pipe pressure sensor (Ps3). This allows reliable detection of the pressure difference and adequate control of the heat-source expansion valve (23).

In the fifth aspect of the invention, the pressure difference between the refrigerant in the liquid pipe and the low pressure refrigerant is directly obtained from the difference between the pressures detected by the on-liquid-pipe pressure sensor (Ps3) and the low-pressure-side pressure sensor (Ps2). This allows reliable detection of the pressure difference and adequate control of the heat-source expansion valve (23).

In the fourth and sixth aspects of the invention, the on-liquid-pipe temperature sensor (Ts7) is used in place of the on-liquid-pipe pressure sensor (Ps3). This relatively low-cost sensor allows estimation of the pressure difference between the high pressure refrigerant and the refrigerant in the liquid pipe, and the pressure difference between the refrigerant in the liquid pipe and the low pressure refrigerant.

In the seventh aspect of the invention, the cooling means (28) cools the refrigerant reduced in pressure by the heat-source expansion valve (23) in the concurrent operation. Therefore, the liquid refrigerant can be sent to the heat exchangers (31, 41, 51). This allows the reduction of noise generated upon passage of the refrigerant through the expansion valve (32, 42, 52) corresponding to the heat exchanger (31, 41, 51) in the concurrent operation.

Particularly in the eighth aspect of the invention, the degree of opening of the pressure reducing valve (19*a*) of the injection pipe (19) is adjusted so that the difference in temperature between the refrigerant flowing into the subcooling heat exchanger (28) and the refrigerant flowing out of the subcooling heat exchanger (28) will be a predetermined value. Thus, the refrigerant in the liquid pipe (15) can reliably be subcooled to become the liquid refrigerant. Thus, the noise generated upon passage of the refrigerant through the expansion valve (32, 42, 52) corresponding to the heat exchanger (31, 41, 51) in the concurrent operation can be reduced with more reliability.

EXPLANATION OF REFERENCE NUMERALS

Figure 1:
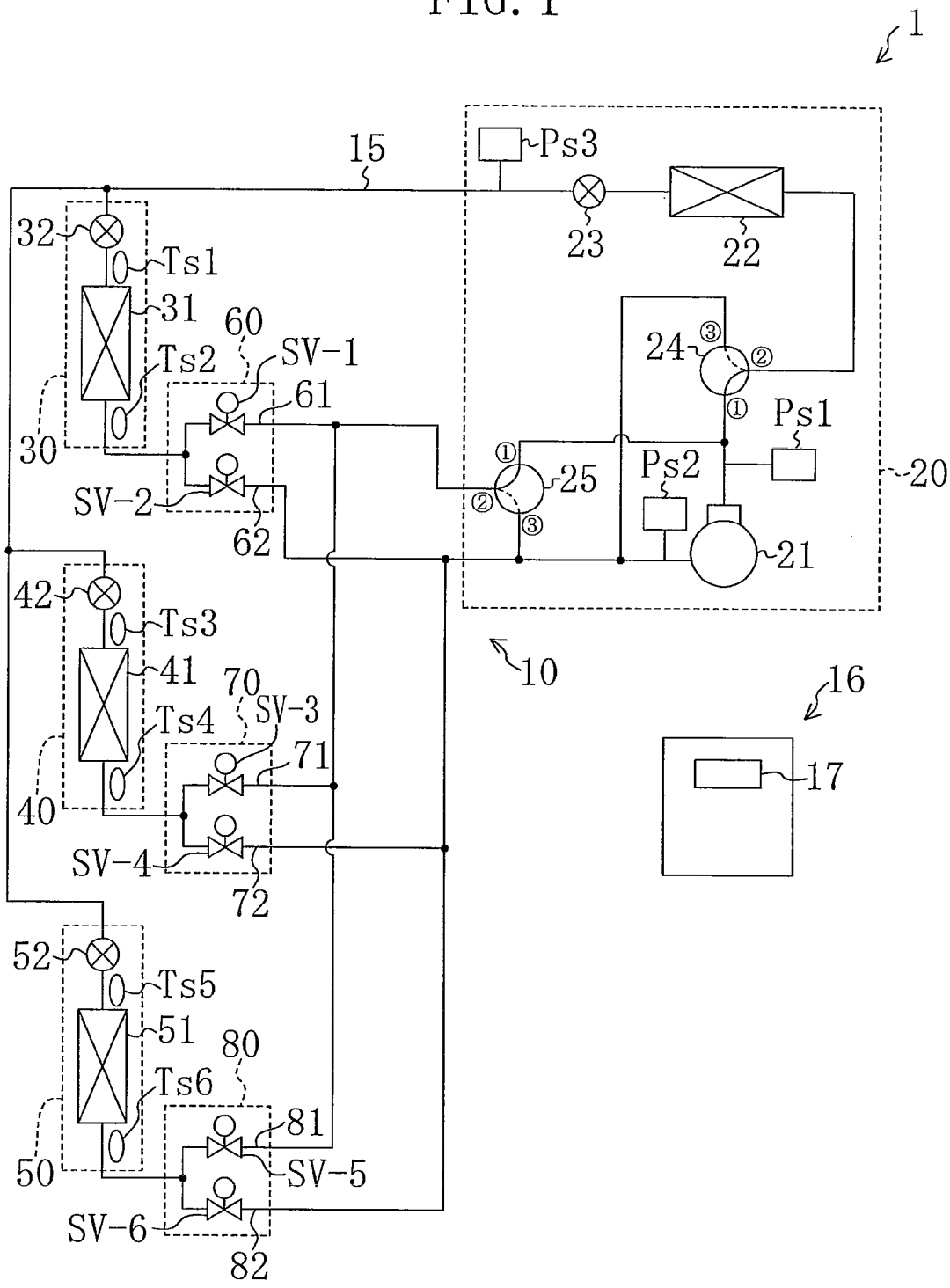
FIG. 1 is a piping diagram of a refrigerant circuit in a refrigeration system according to Embodiment 1 of the present invention.

1 Air conditioner (refrigeration system)
10 Refrigerant circuit
15 Liquid pipe
17 Liquid pressure control means
18 Injection amount control means
19 Injection pipe
19*a* Pressure reducing valve
21 Compressor
22 Outdoor heat exchanger (heat-source heat exchanger)
23 Outdoor expansion valve (heat-source expansion valve)
24, 25 First and second three-way valves (switching mechanism)
28 Subcooling heat exchanger (cooling means)
31, 41, 51 Indoor heat exchanger (heat exchanger)
32, 42, 52 Indoor expansion valve (expansion valve)
92 Second outdoor heat exchanger (heat exchanger)
93 Second outdoor expansion valve (expansion valve)
SV Solenoid valve (switching mechanism)
Ps1 High-pressure-side pressure sensor (high-pressure-side pressure difference detection means, condensation temperature detection means)

Ps2 On-liquid-pipe pressure sensor (high-pressure-side pressure difference detection means, low-pressure-side pressure difference detection means)

Ps3 Low-pressure-side pressure sensor (low-pressure-side pressure difference detection means)

Ts7 On-liquid-pipe temperature sensor (high-pressure-side pressure difference detection means, low-pressure-side pressure difference detection means)

Ts7, Ts8 First and second on-liquid-pipe temperature sensor (temperature difference detection means)

BEST MODE FOR CARRYING OUT THE INVENTION

Hereinafter, embodiments of the present invention will be described in detail with reference to the accompanying drawings.

Embodiment 1

A refrigeration system according to Embodiment 1 of the present invention constitutes an air conditioner (1) capable of individually heating or cooling a plurality of rooms. The air conditioner (1) is an independently switchable air conditioner capable of heating one room and cooling the other rooms simultaneously.

As shown in FIG. 1, the air conditioner (1) according to Embodiment 1 includes a refrigerant circuit (10) constituted of a single outdoor unit (20), three indoor units (30, 40, 50), and three BS units (60, 70, 80) connected by pipes. In the refrigerant circuit (10), a refrigerant is circulated to perform a vapor compression refrigeration cycle.

(Structure of Outdoor Unit)

The outdoor unit (20) constitutes a heat-source unit, and includes a compressor (21), an outdoor heat exchanger (22), an outdoor expansion valve (23), a first three-way valve (24), and a second three-way valve (25). The compressor (21) constitutes a variable-volume inverter compressor. The outdoor heat exchanger (22) is a cross-fin heat exchanger and constitutes a heat-source heat exchanger of the present invention. The outdoor expansion valve (23) is an electronic expansion valve and constitutes a heat-source expansion valve of the present invention.

The first three-way valve (24) and the second three-way valve (25) are constituted of four-way valves, respectively, in each of which one of four ports has been sealed. That is, each of the three-way valves (24, 25) has first to third ports. In the first three-way valve (24), the first port is connected to a discharge side of the compressor (21), the second port is connected to the outdoor heat exchanger (22), and the third port is connected to a suction side of the compressor (21). In the second three-way valve (25), the first port is connected to the discharge side of the compressor (21), the second port is connected to the BS units (60, 70, 80), and the third port is connected to the suction side of the compressor (21). Each f the three-way valves (24, 25) is switchable between a state in which the first port and the second port communicate with each other, and simultaneously, the third port is closed (a state indicated by a solid line in FIG. 1), and a state in which the second port and the third port communicate with each other, and simultaneously, the first port is closed (a state indicated by a broken line in FIG. 1). Each of the three-way valves (24, 25) constitutes a switching mechanism of the present invention.

The outdoor unit (20) is provided with a plurality of pressure sensors (Ps1, Ps2, Ps3) for detecting pressure of the refrigerant. Specifically, a high-pressure-side pressure sensor (Ps1) for detecting pressure of a high pressure refrigerant is provided on the discharge side of the compressor (21), and a low-pressure-side pressure sensor (Ps2) for detecting pressure of a low pressure refrigerant is provided on the suction side of the compressor (21). An on-liquid-pipe pressure sensor (Ps3) for detecting pressure of the refrigerant flowing in the liquid pipe (15) is provided on a liquid pipe (15) between the outdoor expansion valve (23) and the indoor units (30, 40, 50). The high-pressure-side pressure sensor (Ps1) and the on-liquid-pipe pressure sensor (Ps3) constitute a high-pressure-side pressure difference detection means of the present invention for detecting an index of pressure difference between the high pressure refrigerant on the discharge side of the compressor (21) and the refrigerant in the liquid pipe (15). Further, the on-liquid-pipe pressure sensor (Ps3) and the low-pressure-side pressure sensor (Ps2) constitute a low-pressure-side pressure difference detection means of the present invention for detecting an index of pressure difference between the refrigerant in the liquid pipe (15) and the low pressure refrigerant on the suction side of the compressor (21).

(Structure of Indoor Unit)

The air conditioner (1) includes first to third indoor units (30, 40, 50). The indoor units (30, 40, 50) include first to third indoor heat exchangers (31, 41, 51) and first to third indoor expansion valves (32, 42, 52), respectively. The indoor heat exchangers (31, 41, 51) are cross-fin heat exchangers and constitute heat-using heat exchangers. The indoor heat exchangers (31, 41, 51) constitute "a plurality of heat exchangers" as claimed, which are connected in parallel to an end of the liquid pipe (15) at one ends thereof. The indoor expansion valves (32, 42, 52) are, for example, electronic expansion valves. The indoor expansion valves (32, 42, 52) constitute "a plurality of expansion valves" as claimed, each of which is provided on one end of the corresponding indoor heat exchanger (31, 41, 51).

Each of the indoor units (30, 40, 50) includes a plurality of temperature sensors (Ts1, Ts2, Ts3, . . . ) for detecting the refrigerant's temperature. Specifically, in the first indoor unit (30), a first temperature sensor (Ts1) is arranged between an end of the first indoor heat exchanger (31) and the first indoor expansion valve (32), and a second temperature sensor (Ts2) is arranged at the other end of the first indoor heat exchanger (31). In the second indoor unit (40), a third temperature sensor (Ts3) is arranged between an end of the second indoor heat exchanger (41) and the second indoor expansion valve (42), and a fourth temperature sensor (Ts4) is arranged at the other end of the second indoor heat exchanger (41). Further, in the third indoor unit (50), a fifth temperature sensor (Ts5) is arranged between an end of the third indoor heat exchanger (51) and the third indoor expansion valve (52), and a sixth temperature sensor (Ts6) is arranged at the other end of the third indoor heat exchanger (51).

(Structure of BS Unit)

The air conditioner (1) includes first to third BS units (60, 70, 80) corresponding to the indoor units (30, 40, 50), respectively. Each of the BS units (60, 70, 80) includes a first branch pipe (61, 71, 81) and a second branch pipe (62, 72, 82) branched from the corresponding indoor unit (30, 40, 50). Each of the first branch pipes (61, 71, 81) and the second branch pipes (62, 72, 82) is provided with an open/close solenoid valve (SV-1, SV-2, SV-3, . . . ). The BS unit (60, 70, 80) constitutes a switching mechanism of the present invention which switches the flow path of the refrigerant by opening or closing the solenoid valve (SV1, SV-2, SV-3, . . . ) so that the other end of the corresponding indoor heat exchanger (31, 41, 51) is connected to the suction side or the discharge side of the compressor (21).

(Structure of Controller)

The air conditioner (1) has a controller (16) which controls the three-way valves (24, 25), the solenoid valves (SV-1, SV-2, SV-3, . . . ), the compressor (21), and the like. The controller (16) receives signals detected by the above-described sensors. Further, the controller (16) is provided with an expansion valve control means (17), which constitutes a feature of the present invention. The expansion valve control means (17) is configured to perform, in concurrent operation of the present invention described later, liquid pressure control operation by adjusting the degree of opening of the outdoor expansion valve (23) in response to pressure difference between the high pressure refrigerant and the refrigerant in the liquid pipe (15), and pressure difference between the refrigerant in the liquid pipe (15) and the low pressure refrigerant.

-Operation Mechanism-

An operation mechanism of the air conditioner (1) of Embodiment 1 will be described. In the air conditioner (1), the operation can be performed in various modes depending on the setting of the three-way valves (24, 25) and the open/close state of the solenoid valves (SV-1, SV-2, SV-3, . . . ) of the BS units (60, 70, 80). Among them, representative operation modes will be described below.

(All Heating Operation)

Figure 2:
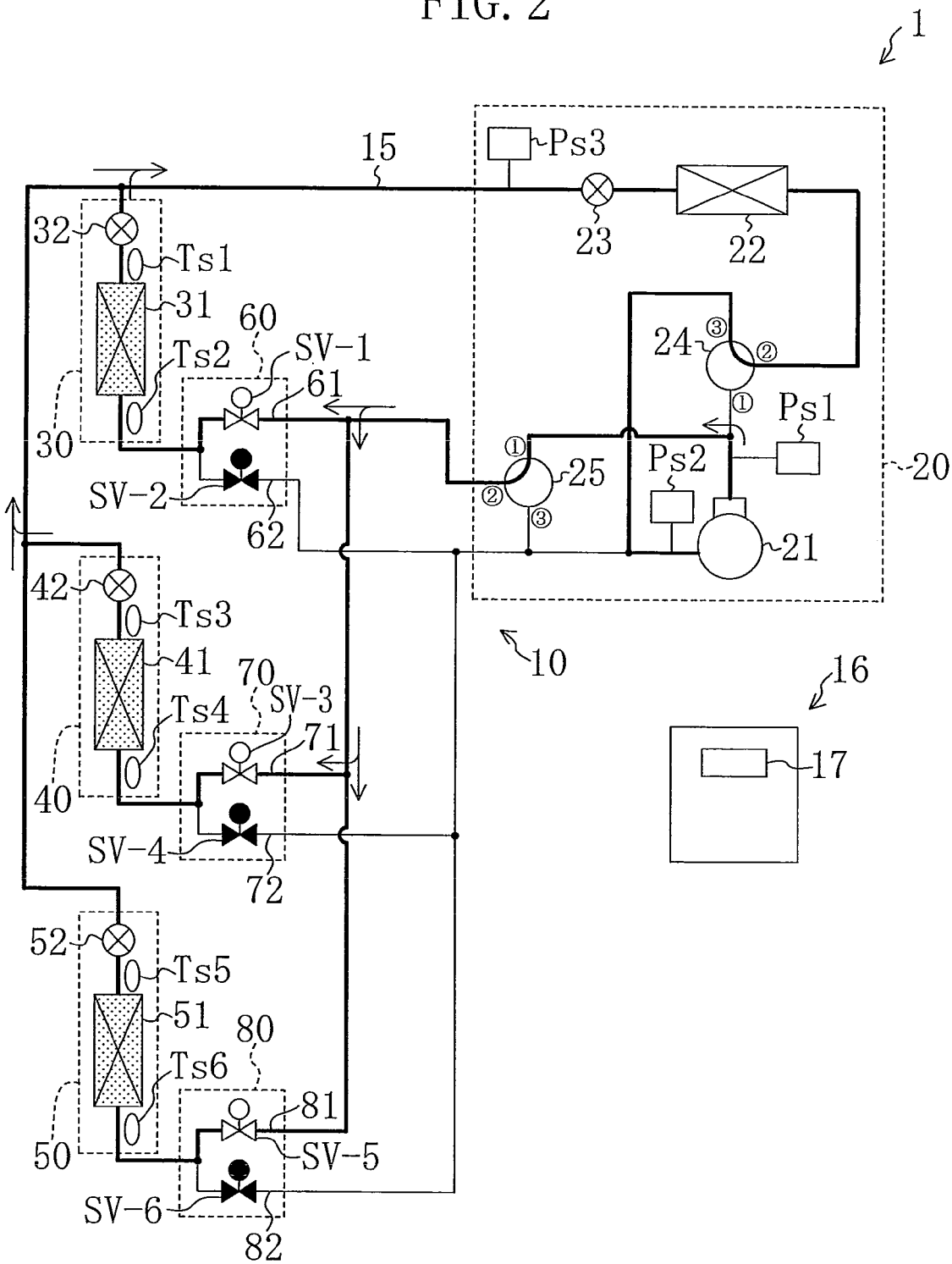
FIG. 2 is a piping diagram of the refrigerant circuit in the refrigeration system according to Embodiment 1 of the present invention illustrating a refrigerant flow in all heating operation.

In all heating operation, all the indoor units (30, 40, 50) perform heating of the corresponding rooms. As shown in FIG. 2, in this operation, each of the three-way valves (24, 25) is set to the state where the first port and the second port communicate with each other. In the BS units (60, 70, 80), the first solenoid valve (SV-1), the third solenoid valve (SV-3), and the fifth solenoid valve (SV-5) are opened, and the second solenoid valve (SV-2), the fourth solenoid valve (SV-4), and the sixth solenoid valve (SV-6) are closed. In this figure and the other figures illustrating the other operation mechanisms, closed solenoid valves are shown as black solenoid valves, and opened solenoid valves are shown as white solenoid valves.

In this operation, a refrigeration cycle is performed in which the outdoor heat exchanger (22) functions as an evaporator, and the indoor heat exchangers (31, 41, 51) function as condensers. In this figure and the other figures illustrating the other operation mechanisms, heat exchangers serving as condensers are shown as dot-patterned heat exchangers, and heat exchangers serving as evaporators are shown as white heat exchangers. In this refrigeration cycle, the refrigerant discharged from the compressor (21) passes through the second three-way valve (25), and is divided to flow into the first branch pipes (61, 71, 81) of the BS units (60, 70, 80), respectively. After passing through the BS units (60, 70, 80), the refrigerant is sent to the corresponding indoor units (30, 40, 50).

For example, in the first indoor unit (30), when the refrigerant flows into the first indoor heat exchanger (31), it dissipates heat into indoor air in the first indoor heat exchanger (31) and condenses. As a result, the room corresponding to the first indoor unit (30) is heated. The refrigerant condensed in the first indoor heat exchanger (31) passes through the first indoor expansion valve (32). The degree of opening of the first indoor expansion valve (32) is adjusted in response to the degree of subcooling of the refrigerant obtained by the first temperature sensor (Ts1), the second temperature sensor (Ts2), and the like. Specifically, the degree of opening of the first indoor expansion valve (32) is increased so as to increase the flow rate of the refrigerant when a heating demand in the room is high, and the degree of subcooling of the refrigerant is high. On the other hand, the degree of opening of the first indoor expansion valve (32) is reduced so as to reduce the flow rate of the refrigerant when the heating demand in the room is low, and the degree of subcooling of the refrigerant is low. In the second indoor unit (40) and the third indoor unit (50), the refrigerant flows in the same manner as in the first indoor unit (30), and the corresponding rooms are heated.

The refrigerants discharged from the indoor units (30, 40, 50) are joined into one in the liquid pipe (15). The refrigerant is reduced in pressure as it passes through the outdoor expansion valve (23) to become a low pressure refrigerant, and flows into the outdoor heat exchanger (22). In the outdoor heat exchanger (22), the refrigerant absorbs heat from outdoor air and evaporates. The refrigerant evaporated in the outdoor heat exchanger (22) passes through the first three-way valve (24), and is sucked into the compressor (21) for recompression.

(All Cooling Operation)

Figure 3:
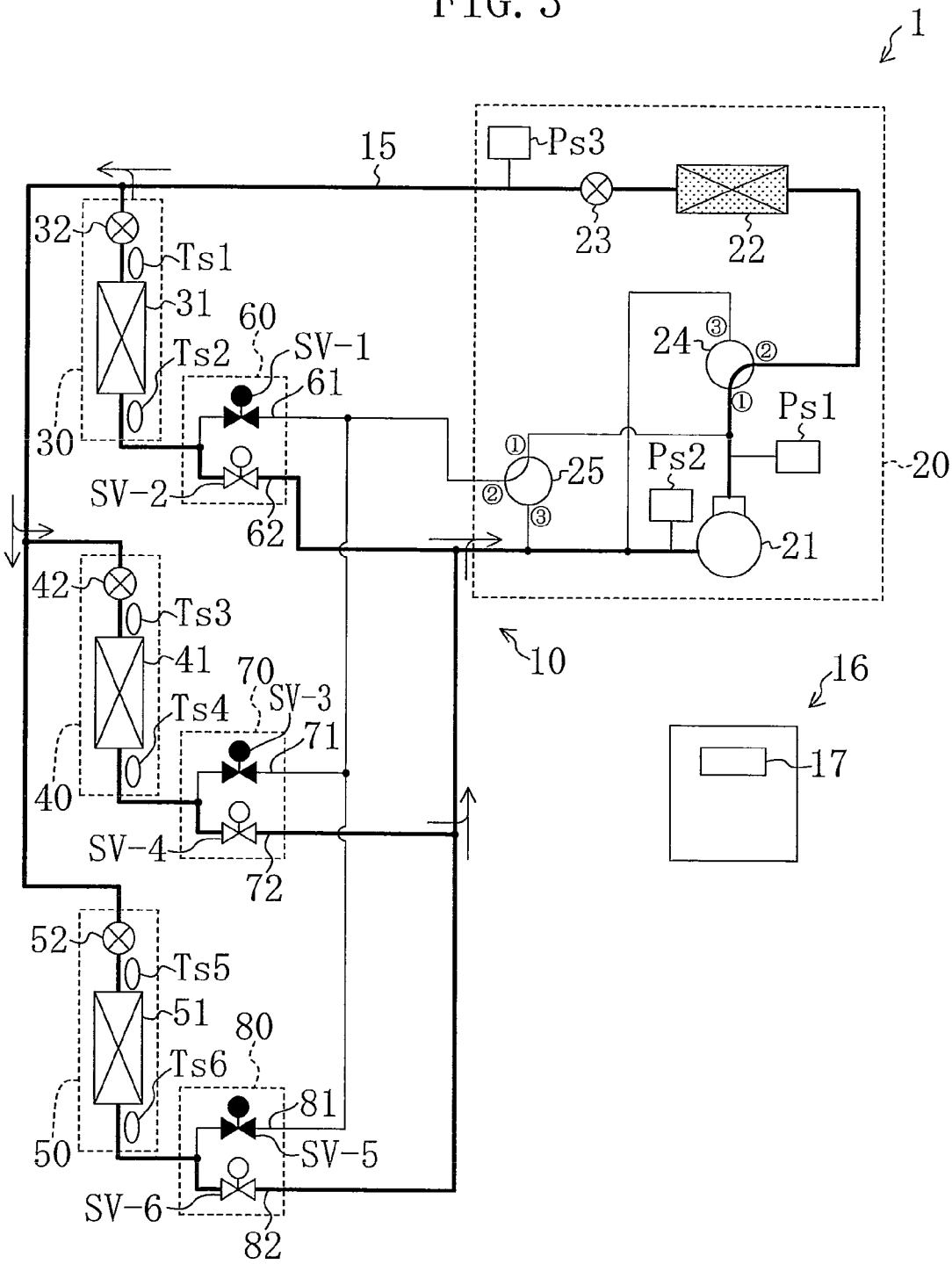
FIG. 3 is a piping diagram of the refrigerant circuit in the refrigeration system according to Embodiment 1 of the present invention illustrating a refrigerant flow in all cooling operation.

In all cooling operation, all the indoor units (30, 40, 50) perform cooling of the corresponding rooms. As shown in FIG. 3, in this operation, each of the three-way valves (24, 25) is set to the state where the first port and the second port communicate with each other. In the BS units (60, 70, 80), the second solenoid valve (SV-2), the fourth solenoid valve (SV-4), and the sixth solenoid valve (SV-6) are opened, and the first solenoid valve (SV-1), the third solenoid valve (SV-3), and the fifth solenoid valve (SV-5) are closed.

In this operation, a refrigeration cycle is performed in which the outdoor heat exchanger (22) functions as a condenser, and the indoor heat exchangers (31, 41, 51) function as evaporators. Specifically, the refrigerant discharged from the compressor (21) passes through the first three-way valve (24), and flows into the outdoor heat exchanger (22). In the outdoor heat exchanger (22), the refrigerant dissipates heat into the outdoor air and condenses. The refrigerant condensed in the outdoor heat exchanger (22) passes through the fully opened outdoor expansion valve (23), flows through the liquid pipe (15), and is divided to flow into the indoor units (30, 40, 50).

For example, in the first indoor unit (30), the refrigerant is reduced in pressure as it passes through the first indoor expansion valve (32) to become a low pressure refrigerant, and flows into the first indoor heat exchanger (31). In the first indoor heat exchanger (31), the refrigerant absorbs heat from the indoor air and evaporates. As a result, the room corresponding to the first indoor unit (30) is cooled. The degree of opening of the first indoor expansion valve (32) is adjusted in response to the degree of superheating of the refrigerant obtained by the first temperature sensor (Ts1), the second temperature sensor (Ts2), and the like. Specifically, the degree of opening of the first indoor expansion valve (32) is increased so as to increase the flow rate of the refrigerant when a cooling demand in the room is high, and the degree of superheating of the refrigerant is high. On the other hand, the degree of opening of the first indoor expansion valve (32) is reduced so as to reduce the flow rate of the refrigerant when the cooling demand in the room is low, and the degree of superheating of the refrigerant is low. In the second indoor unit (40) and the third indoor unit (50), the refrigerant flows in the same maimer as in the first indoor unit (30), and the corresponding rooms are cooled. The refrigerants discharged from the indoor units (30, 40, 50) pass through the second branch pipes (62, 72, 82) of the BS units (60, 70, 80), respectively, and they are joined into one and sucked into the compressor (21) for recompression.

(Simultaneous Heating/Cooling Operation)

In simultaneous heating/cooling operation, some indoor units perform heating of the rooms, and the other indoor units perform cooling of the rooms. In the simultaneous heating/cooling operation, the outdoor heat exchanger (22) functions as an evaporator or a condenser depending on the operating condition. In the indoor units (30, 40, 50), the indoor heat exchanger in the room which demands the heating functions as a condenser, while the indoor heat exchanger in the room which demands the cooling functions as an evaporator. Hereinafter, examples of concurrent operation according to the present invention will be described, in which the outdoor heat exchanger (22) is used as a condenser, at least one of the indoor heat exchangers (31, 41, 51) is used as a condenser, and the remaining indoor heat exchangers are used as evaporators.

(First Concurrent Operation)

Figure 4:
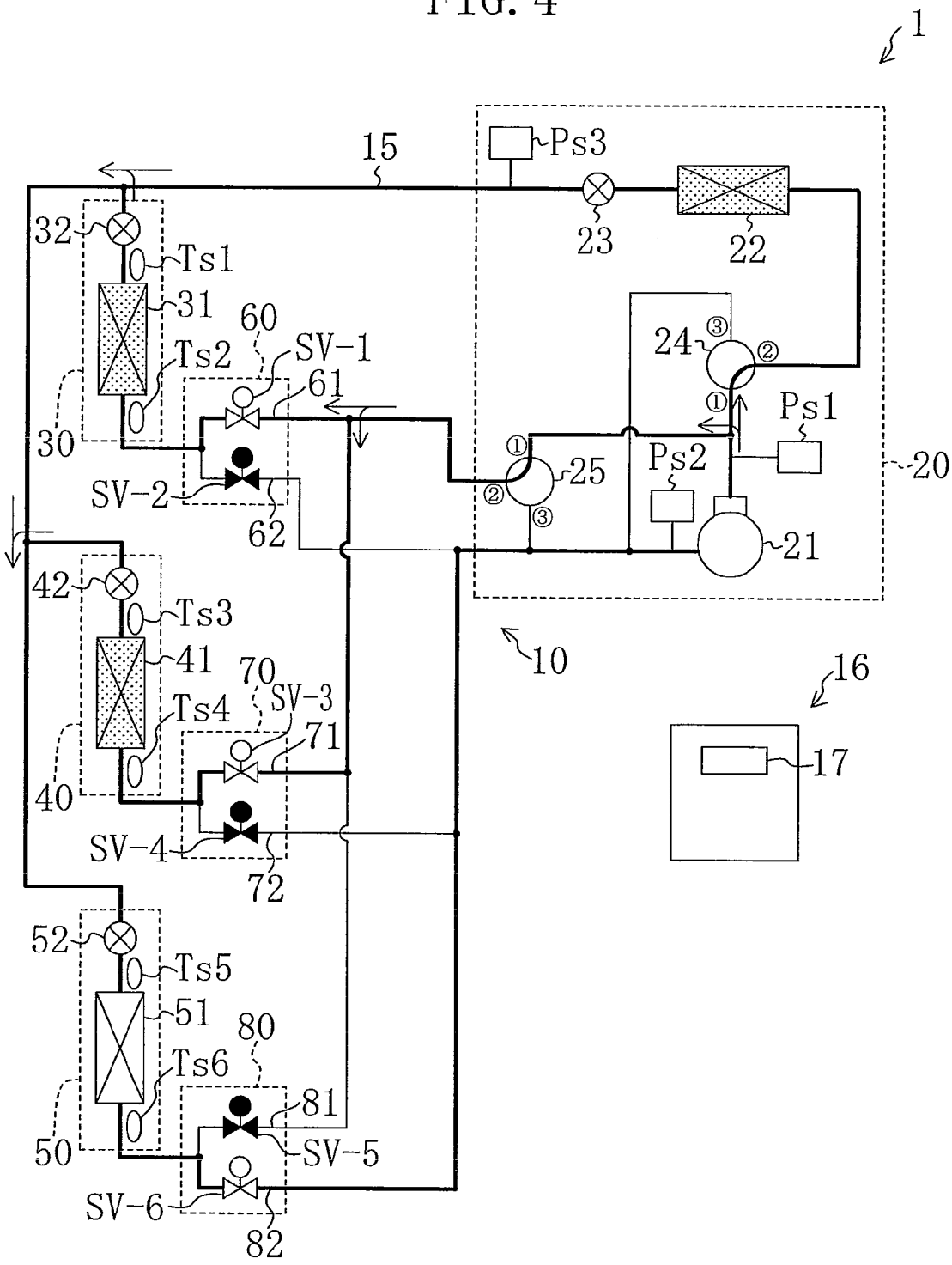
FIG. 4 is a piping diagram of the refrigerant circuit in the refrigeration system according to Embodiment 1 of the present invention illustrating a refrigerant flow in first concurrent operation of simultaneous heating/cooling operation.

In first concurrent operation, the first indoor unit (30) and the second indoor unit (40) perform heating of the corresponding rooms, and the third indoor unit (50) performs cooling of the corresponding room. As shown in FIG. 4, in this operation, each of the three-way valves (24, 25) is set to the state where the first port and the second port communicate with each other. In the BS units (60, 70, 80), the first solenoid valve (SV-1), the third solenoid valve (SV-3), and the sixth solenoid valve (SV-6) are opened, and the second solenoid valve (SV-2), the fourth solenoid valve (SV-4), and the fifth solenoid valve (SV-5) are closed.

In this operation, a refrigeration cycle is performed in which the outdoor heat exchanger (22), the first indoor heat exchanger (31), and the second indoor heat exchanger (41) function as condensers, and the third indoor heat exchanger (51) functions as an evaporator. Specifically, the refrigerant discharged from the compressor (21) is divided to flow into the first three-way valve (24) and the second three-way valve (25). The refrigerant passed through the first three-way valve (24) condenses in the outdoor heat exchanger (22), passes through the outdoor expansion valve (23) opened to a predetermined degree, and then flows into the liquid pipe (15).

On the other hand, the refrigerant passed through the second three-way valve (25) is divided to flow into the first BS unit (60) and the second BS unit (70). The refrigerant flowed out of the first BS unit (60) flows into the first indoor heat exchanger (31). In the first indoor heat exchanger (31), the refrigerant dissipates heat into the indoor air and condenses. As a result, the room corresponding to the first indoor unit (30) is heated. The degree of opening of the first indoor expansion valve (32) is adjusted in response to the heating demand in the room, in the same manner as in the all heating operation described above. The refrigerant used in the first indoor unit (30) to heat the room flows into the liquid pipe (15). Likewise, the refrigerant flowed out of the second BS unit (70) is used in the second indoor unit (40) to heat the room, and then flows into the liquid pipe (15).

The refrigerants are joined into one in the liquid pipe (15), and guided to the third indoor unit (50). The refrigerant is reduced in pressure as it passes through the third indoor expansion valve (52) to become a low pressure refrigerant, and then flows into the third indoor heat exchanger (51). In the third indoor heat exchanger (51), the refrigerant absorbs heat from the indoor air and evaporates. As a result, the room corresponding to the third indoor unit (50) is cooled. The refrigerant used in the third indoor unit (50) to cool the room passes through the third BS unit (80), and is sucked into the compressor (21) for recompression.

(Second Concurrent Operation)

Figure 5:
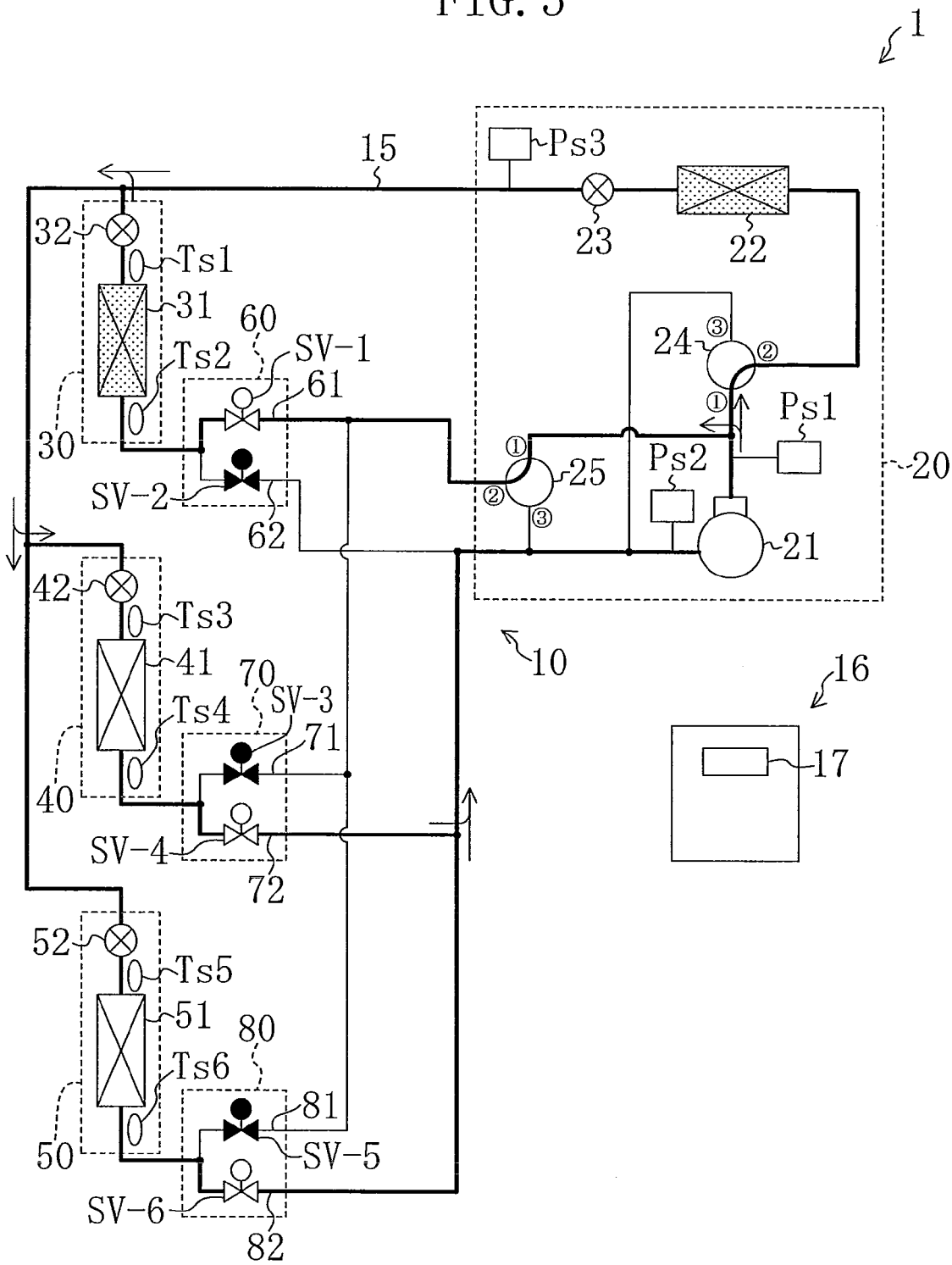
FIG. 5 is a piping diagram of the refrigerant circuit in the refrigeration system according to Embodiment 1 of the present invention illustrating a refrigerant flow in second concurrent operation of simultaneous heating/cooling operation.

In second concurrent operation, the first indoor unit (30) performs heating of the corresponding room, and the second indoor unit (40) and the third indoor unit (50) perform cooling of the corresponding rooms. As shown in FIG. 5, in this operation, each of the three-way valves (24, 25) is set to the state where the first port and the second port communicate with each other. In the BS units (60, 70, 80), the first solenoid valve (SV-1), the fourth solenoid valve (SV-4), and the sixth solenoid valve (SV-6) are opened, and the second solenoid valve (SV-2), the third solenoid valve (SV-3), and the fifth solenoid valve (SV-5) are closed.

In this operation, a refrigeration cycle is performed in which the outdoor heat exchanger (22) and the first indoor heat exchanger (31) function as condensers, and the second indoor heat exchanger (41) and the third indoor heat exchanger (51) function as evaporators. Specifically, the refrigerant discharged from the compressor (21) is divided to flow into the first three-way valve (24) and the second three-way valve (25). The refrigerant passed through the first three-way valve (24) condenses in the outdoor heat exchanger (22), passed through the outdoor expansion valve (23) opened to a predetermined degree, and then flows into the liquid pipe (15).

On the other hand, the refrigerant passed through the second three-way valve (25) is sent to the first indoor unit (30) through the first BS unit (60). In the first indoor unit (30), the refrigerant condenses in the first indoor heat exchanger (31) to heat the room. The refrigerant used in the first indoor unit (30) to heat the room flows into the liquid pipe (15).

The refrigerants are joined into one in the liquid pipe (15), and then divided to flow into the second indoor unit (40) and the third indoor unit (50). In the second indoor unit (40), the refrigerant reduced in pressure by the second indoor expansion valve (42) evaporates in the second indoor heat exchanger (41) to cool the room. Likewise, in the third indoor unit (50), the refrigerant reduced in pressure by the third indoor expansion valve (52) evaporates in the third indoor heat exchanger (51) to cool the room. The refrigerants used in the indoor units (40, 50) to cool the rooms pass through the second BS unit (70) and the third BS unit (80), respectively, and they are joined into one and sucked into the compressor (21) for recompression.

-Liquid Pressure Control Operation-

In the above-described concurrent operation using the outdoor heat exchanger (22) as a condenser, heating or cooling capability of the indoor units (30, 40, 50) may deteriorate due to an imbalance in refrigerant flow. This phenomenon will be described with reference to the first and second concurrent operations described above.

(Liquid Pressure Control Operation in First Concurrent Operation)

As shown in FIG. 4, in the concurrent operation of performing a refrigeration cycle in which the outdoor heat exchanger (22) functions as a condenser, one or more indoor heat exchangers (31, 41) function as condensers, and one or more indoor heat exchangers (51) function as evaporators, the heating capability may deteriorate due to the imbalance in refrigerant flow. Specifically, in the indoor units (30, 40) which perform the heating as described above, the degree of opening of the indoor expansion valves (32, 42) is adjusted in response to the heating demand in the corresponding rooms. For example, when the heating demand on the indoor units (30, 40) is high, and the degree of opening of the indoor expansion valves (32, 42) is increased, pressure difference between the high pressure refrigerant on the discharge side of the compressor (21) and the refrigerant in the liquid pipe (15) may be reduced. Therefore, most of the refrigerant discharged from the compressor (21) flows into the outdoor heat exchanger (22), and consequently, the amount of the refrigerant sent to the first indoor unit (30) and the second indoor unit (40) is reduced. This results in decrease in heating capability of the first indoor unit (30) and the second indoor unit (40), and deterioration of reliability of the air conditioner (1). Further, in the concurrent operation using two or more indoor heat exchangers (31, 41) as condensers as shown in FIG. 4, the reduced pressure difference between the high pressure refrigerant and the refrigerant in the liquid pipe (15) makes it difficult to send the refrigerant to the indoor unit which is away from the compressor (21) and experiences relatively high pressure loss in the refrigerant pipe (e.g., the second indoor unit (40)). That is, in this example, when the pressure difference between the high pressure refrigerant and the refrigerant in the liquid pipe (15) is reduced, a predetermined amount of the refrigerant can reliably be supplied to the first indoor unit (30) close to the compressor (21). However, the amount of the refrigerant in the second indoor unit (40) becomes insufficient, and the heating capability of the second indoor unit (40) may deteriorate. In view of this, the expansion valve control means (17) of the present embodiment performs the following liquid pressure control operation to prevent the deterioration of the heating capability due to the imbalance in refrigerant flow.

In the concurrent operation shown in FIG. 4, the high-pressure-side pressure sensor (Ps1) detects the pressure of the high pressure refrigerant on the discharge side of the compressor (21). At the same time, the on-liquid-pipe pressure sensor (Ps3) detects the pressure of the refrigerant flowing in the liquid pipe (15). Then, difference between the pressure detected by the high-pressure-side pressure sensor (Ps1) and the pressure detected by the on-liquid-pipe pressure sensor (Ps3) is obtained as pressure difference ΔP1 between the high pressure refrigerant and the refrigerant in the liquid pipe (15).

The expansion valve control means (17) adjusts the degree of opening of the outdoor expansion valve (23) so that the pressure difference ΔP1 thus obtained becomes larger than a predetermined target value. The target value is variable depending on indoor temperature, outdoor temperature, operation states of the indoor units (30, 40, 50), operation frequency of the compressor (21), and the like. Further, the expansion valve control means (17) adjusts the degree of opening of the outdoor expansion valve (23) so that the pressure difference ΔP1 does not exceed a predetermined upper limit value. That is, the expansion valve control means (17) adjusts the degree of opening of the outdoor expansion valve (23) to keep the pressure difference ΔP1 within a predetermined target range.

When the pressure difference between the high pressure refrigerant and the refrigerant in the liquid pipe (15) is reduced for the above-described reason, and therefore pressure difference ΔP1 becomes equal to or smaller than a predetermined value, the expansion valve control means (17) reduces the degree of opening of the outdoor expansion valve (23). This reduces the pressure of the refrigerant in the liquid pipe (15), and the pressure difference ΔP1 becomes larger than the predetermined value. As a result, the pressure difference between the high pressure refrigerant and the refrigerant in the liquid pipe can be maintained at a certain level or higher. Thus, the refrigerant discharged from the compressor (21) sufficiently flows into the first indoor unit (30) and the second indoor unit (40), and the heating capability of the indoor units (30, 40) can reliably be maintained at a sufficient level.

The outdoor expansion valve (23) is adjusted so that the pressure difference ΔP1 does not exceed the upper limit value. Specifically, the degree of opening of the outdoor expansion valve (23) is adjusted so as to prevent excessive reduction of the pressure of the refrigerant. This avoids excessive decrease in pressure of the refrigerant flowing in the liquid pipe (15).

(Liquid Pressure Control Operation in Second Concurrent Operation)

As shown in FIG. 5, in the above-described concurrent operation to perform a refrigeration cycle in which the outdoor heat exchanger (22) functions as a condenser, two or more indoor heat exchangers (41, 51) function as evaporators, and one or more indoor heat exchangers (31) function as condensers, the heating capability and the cooling capability may deteriorate due to the imbalance in refrigerant flow. Specifically, in the same manner as shown in FIG. 4, the heating capability of the first indoor heat exchanger (31) may become insufficient due to the imbalance in refrigerant flow between the outdoor heat exchanger (22) and the first indoor heat exchanger (31). When the degree of opening of the outdoor expansion valve (23) is reduced by the above-described liquid pressure control operation so as to maintain the pressure difference between the high pressure refrigerant and the refrigerant in the liquid pipe, the pressure difference between the refrigerant in the liquid pipe and the low pressure refrigerant becomes too small. This makes it difficult to send the refrigerant to the indoor unit which is away from the compressor (21) and experiences relatively high pressure loss in the refrigerant pipe (e.g., the third indoor unit (50)). That is, in this example, when the pressure difference between the refrigerant in the liquid pipe (15) and the low pressure refrigerant is reduced, a predetermined amount of the refrigerant can reliably be supplied from the compressor (21) to the second indoor unit (40). However, the amount of the refrigerant in the third indoor unit (50) becomes insufficient, and the cooling capability of the third indoor unit (50) may deteriorate. In view of this, the expansion valve control means (17) of the present embodiment performs the following liquid pressure control operation to prevent the deterioration of the cooling capability due to the imbalance in refrigerant flow.

In the concurrent operation shown in FIG. 5, pressure difference ΔP1 between the high pressure refrigerant and the refrigerant in the liquid pipe is obtained by the high-pressure-side pressure sensor (Ps1) and the on-liquid-pipe pressure sensor (Ps3), in the same manner as shown in FIG. 4. Further, in this concurrent operation, the low-pressure-side pressure sensor (Ps2) detects the pressure of the low pressure refrigerant on the suction side of the compressor (21). Then, difference between the pressure detected by the on-liquid-pipe pressure sensor (Ps3) and the pressure detected by the low-pressure-side pressure sensor (Ps2) is obtained as pressure difference ΔP2 between the refrigerant in the liquid pipe (15) and the low pressure refrigerant.

The expansion valve control means (17) adjusts the degree of opening of the outdoor expansion valve (23) so that the pressure difference ΔP1 between the high pressure refrigerant and the refrigerant in the liquid pipe becomes larger than a predetermined target value, and that the pressure difference ΔP2 between the refrigerant in the liquid pipe and the low pressure refrigerant becomes larger than a predetermined target value. The target values are variable depending on indoor temperature, outdoor temperature, preset room temperature, operation states of the indoor units (30, 40, 50), operation frequency of the compressor (21), and the like.

When the pressure difference between the high pressure refrigerant and the refrigerant in the liquid pipe (15) is reduced, and the pressure difference ΔP1 between the high pressure refrigerant and the refrigerant in the liquid pipe becomes equal to or smaller than the predetermined value for the above-described reason, the expansion valve control means (17) reduces the degree of opening of the outdoor expansion valve (23). As a result, the pressure difference ΔP1 is maintained, and the imbalance in refrigerant flow between the outdoor heat exchanger (22) and the first indoor heat exchanger (31) is suppressed. This makes it possible to supply a sufficient amount of the refrigerant to the first indoor heat exchanger (31), and to solve the lack of heating capability of the first indoor unit (30).

When the pressure difference between the refrigerant in the liquid pipe (15) and the low pressure refrigerant is reduced, and the pressure difference ΔP2 between the refrigerant in the liquid pipe and the low pressure refrigerant becomes equal to or smaller than the predetermined value, the expansion valve control means (17) increases the degree of opening of the outdoor expansion valve (23). As a result, the pressure of the refrigerant in the liquid pipe (15) is increased, and the pressure difference ΔP2 is maintained. This suppresses the imbalance in refrigerant flow between the second indoor heat exchanger (41) and the third indoor heat exchanger (51), and maintains the cooling capability of the indoor units (40, 50) at a sufficient level.

Effect of Embodiment 1

In Embodiment 1, the expansion valve control means (17) adjusts, in the above-described first concurrent operation, the degree of opening of the outdoor expansion valve (23) to maintain the pressure difference ΔP1 between the high pressure refrigerant and the refrigerant in the liquid pipe. Therefore, according to Embodiment 1, the imbalance in refrigerant flow between the outdoor heat exchanger (22) and the indoor heat exchangers (31, 41) serving as condensers can be prevented, and a sufficient amount of the refrigerant can reliably be supplied to the indoor heat exchangers (31, 41). This allows prevention of the deterioration in heating capability of the indoor units (30, 40), and improvement in reliability of the air conditioner (1).

In the above-described second concurrent operation, in particular, the expansion valve control means (17) adjusts the degree of opening of the outdoor expansion valve (23) to maintain the pressure difference ΔP1 between the high pressure refrigerant and the refrigerant in the liquid pipe, and to maintain the pressure difference ΔP2 between the refrigerant in the liquid pipe and the low pressure refrigerant. Therefore, according to Embodiment 1, the imbalance in refrigerant flow between the outdoor heat exchanger (22) and the indoor heat exchanger (31) serving as a condenser can be prevented, and simultaneously, the imbalance in refrigerant flow between the indoor heat exchangers (41, 51) serving as evaporators can also be prevented. This allows prevention of the deterioration in heating and cooling capability of the indoor units (30, 40, 50), and improvement in reliability of the air conditioner (1).

Embodiment 2

A refrigeration system according to Embodiment 2 of the present invention is configured by adding a plurality of outdoor units (20, 90) to the air conditioner of Embodiment 1. Hereinafter, difference from Embodiment 1 will be described.

Figure 6:
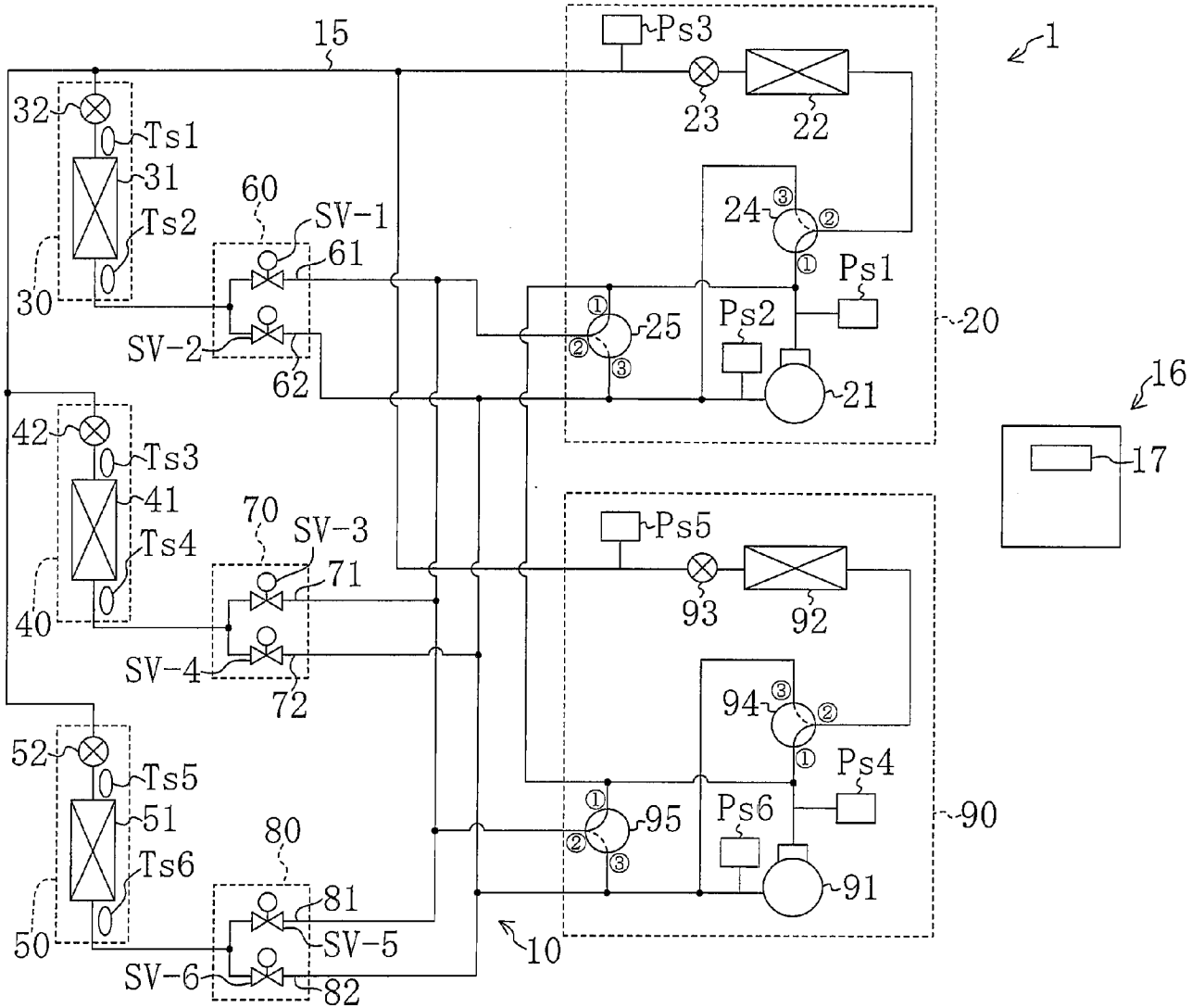
FIG. 6 is a piping diagram of a refrigerant circuit in a refrigeration system according to Embodiment 2 of the present invention.

As shown in FIG. 6, an air conditioner (1) of Embodiment 2 includes a first outdoor unit (20) and a second outdoor unit (90). The outdoor units (20, 90) are configured in the same manner as the outdoor unit of Embodiment 1. That is, the first outdoor unit (20) includes a first compressor (21), a first outdoor heat exchanger (22), a first outdoor expansion valve (23), a first three-way valve (24), a second three-way valve (25), a first high-pressure-side pressure sensor (Ps1), a first low-pressure-side pressure sensor (Ps2), and a first on-liquid-pipe pressure sensor (Ps3). On the other hand, the second outdoor unit (90) includes a second compressor (91), a second outdoor heat exchanger (92), a second outdoor expansion valve (93), a third three-way valve (94), a fourth three-way valve (95), a second high-pressure-side pressure sensor (Ps4), a second low-pressure-side pressure sensor (Ps5), and a second on-liquid-pipe pressure sensor (Ps6).

The air conditioner (1) of Embodiment 2 is also provided with an expansion valve control means (17) which performs liquid pressure control operation in the above-described concurrent operation by adjusting the degree of opening of the outdoor expansion valves (23, 93). In the concurrent operation described in Embodiment 1, the degree of opening of the outdoor expansion valves (23, 93) corresponding to the outdoor heat exchangers (20, 90) serving as condensers is adjusted in response to pressure difference between the high pressure refrigerant and the refrigerant in the liquid pipe, and pressure difference between the refrigerant in the liquid pipe and the low pressure refrigerant.

Further, in the air conditioner of Embodiment 2, the liquid pressure control operation of the present invention can also be applied to the following concurrent operation.

Figure 7:
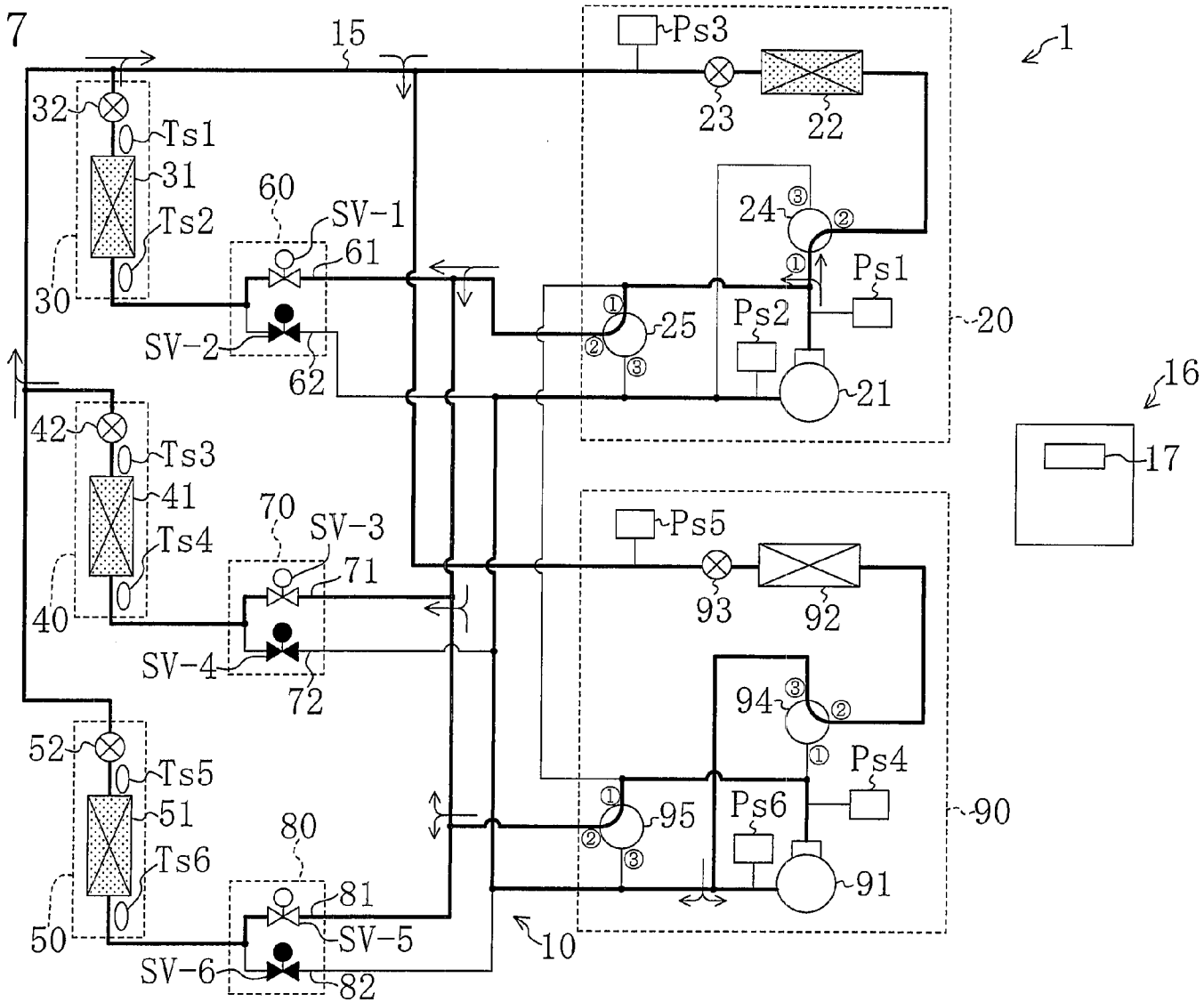
FIG. 7 is a piping diagram of the refrigerant circuit in the refrigeration system according to Embodiment 2 illustrating a refrigerant flow in a first example of the other concurrent operation.

In an example shown in FIG. 7, all the indoor units (30, 40, 50) perform heating, and one outdoor heat exchanger (92) is used as an evaporator. Specifically, in this concurrent operation, a refrigeration cycle is performed in which the first outdoor heat exchanger (22) functions as a condenser, three heat exchangers (the first to third indoor heat exchangers (31, 41, 51)) among the plurality of heat exchangers (31, 41, 51, 92) function as condensers, and the remaining heat exchanger (the second outdoor heat exchanger (92)) functions as an evaporator.

In the example shown in FIG. 7, the imbalance in refrigerant flow may occur between the first outdoor heat exchanger (22) and the indoor heat exchangers (31, 41, 51) for the above-described reason, and the heating capability of the indoor units (30, 40, 50) may possibly deteriorate. In view of this, the expansion valve control means (17) adjusts the degree of opening of the first outdoor expansion valve (23) so that pressure difference ΔP1 between the high pressure refrigerant and the refrigerant in the liquid pipe obtained by the first high-pressure-side pressure sensor (Ps1) and the first on-liquid-pipe pressure sensor (Ps3) becomes larger than a predetermined target value. As a result, a sufficient amount of the refrigerant can be sent to the indoor heat exchangers (31, 41, 51), and the heating capability of the indoor units (30, 40, 50) can reliably be maintained at a sufficient level.

Figure 8:
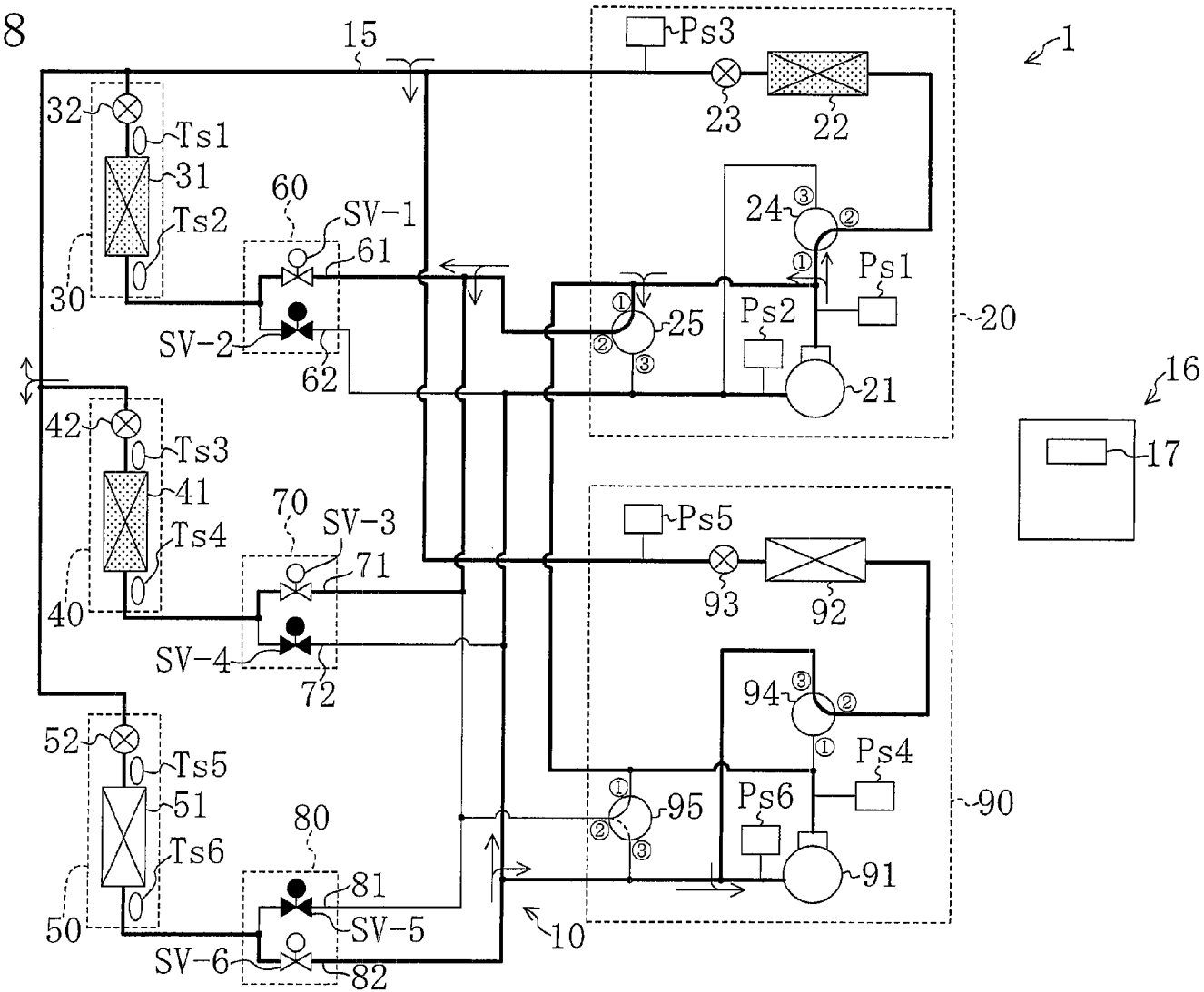
FIG. 8 is a piping diagram of the refrigerant circuit in the refrigeration system according to Embodiment 2 illustrating a refrigerant flow in a second example of the other concurrent operation.

In an example shown in FIG. 8, one or more indoor units (30, 40) perform heating, and simultaneously, the remaining indoor unit (50) performs cooling, and one outdoor heat exchanger (92) functions as an evaporator. Specifically, in this concurrent operation, a refrigeration cycle is performed in which the first outdoor heat exchanger (22) functions as a condenser, two heat exchangers (the third indoor heat exchanger (51) and the second outdoor heat exchanger (92)) among the plurality of heat exchangers (31, 41, 51, 92) function as evaporators, and the remaining heat exchangers (the first indoor heat exchanger (31) and the second indoor heat exchanger (41)) function as condensers.

In the example shown in FIG. 8, the imbalance in refrigerant flow may occur between the first outdoor heat exchanger (22) and the first and second indoor heat exchangers (31, 41) for the above-described reason, and the heating capability of the first and second indoor units (30, 40) may possibly deteriorate. In view of this, the expansion valve control means (17) adjusts the degree of opening of the first outdoor expansion valve (23) so that the pressure difference ΔP1 between the high pressure refrigerant and the refrigerant in the liquid pipe obtained by the first high-pressure-side pressure sensor (Ps1) and the first on-liquid-pipe pressure sensor (Ps3) becomes larger than a predetermined target value. As a result, a sufficient amount of the refrigerant can be sent to the indoor heat exchangers (31, 41, 51), and the heating capability of the indoor units (30, 40, 50) can reliably be maintained at a sufficient level. Further, in this example, the imbalance in refrigerant flow may also occur between the second outdoor heat exchanger (92) and the third indoor heat exchanger (51) for the above-described reason, and the cooling capability of the third indoor unit (50) may possibly deteriorate. In view of this, the expansion valve control means (17) adjusts the degree of opening of the first outdoor expansion valve (23) so that pressure difference ΔP2 between the refrigerant in the liquid pipe and the low pressure refrigerant obtained by the first on-liquid-pipe pressure sensor (Ps3) and the low-pressure-side pressure sensor (Ps2) becomes larger than a predetermined target value. As a result, a sufficient amount of the refrigerant can be sent to the third indoor heat exchanger (51), and the cooling capability of the third indoor unit (50) can reliably be maintained at a sufficient level.

Modified Examples of Embodiments 1 and 2

Embodiments 1 and 2 described above may be modified in the following manner.

(Modified Example of High-Pressure-Side Pressure Detection Means)

Figure 9:
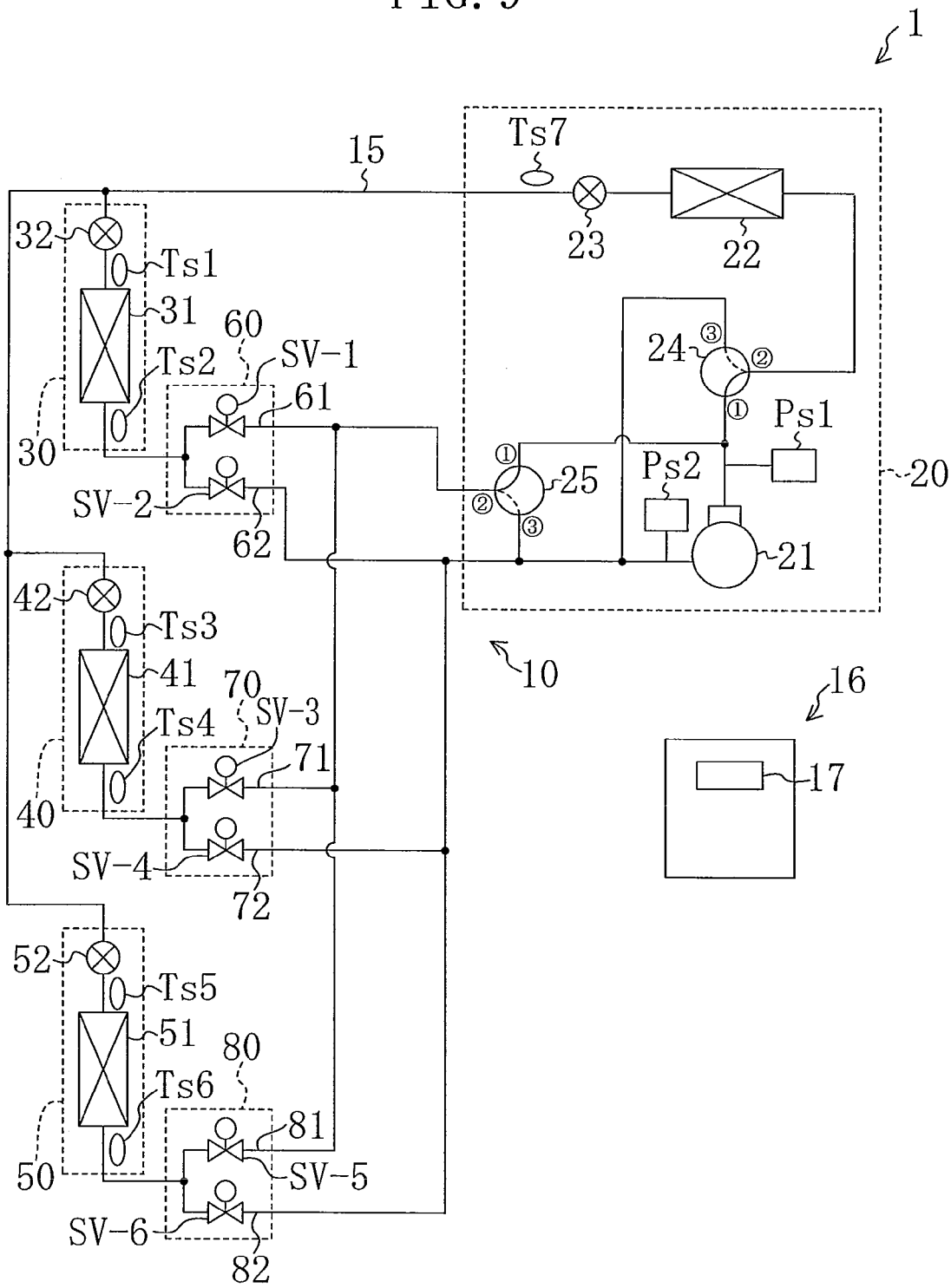
FIG. 9 is a piping diagram of a refrigerant circuit in a first modified example of the refrigeration system according to the embodiments of the present invention.

As a high-pressure-side pressure detection means which detects an index of pressure difference between the high pressure refrigerant and the refrigerant in the liquid pipe, for example, the high-pressure-side pressure sensor (Ps1) and an on-liquid-pipe temperature sensor (Ts8) may be used as shown in FIG. 9. The high-pressure-side pressure sensor (Ps1) constitutes a condensation temperature detection means which detects condensation temperature of the refrigerant in the outdoor heat exchanger (22) in the concurrent operation. Specifically, the condensation temperature in the outdoor heat exchanger (22) can be obtained by calculating saturation temperature corresponding to the pressure detected by the high-pressure-side pressure sensor (Ps1). The condensation temperature in the outdoor heat exchanger (22) may be obtained by directly detecting the temperature of the refrigerant in a heat transfer tube of the outdoor heat exchanger (22).

In the concurrent operation, the refrigerant passed through the outdoor expansion valve (23) is guided to the liquid pipe (15). Since this refrigerant is reduced to a predetermined pressure by the outdoor expansion valve (23), it is in a vapor-liquid two phase. The on-liquid-pipe temperature sensor (Ts8) detects the temperature of the vapor-liquid two phase refrigerant in the liquid pipe (15).

The condensation temperature in the outdoor heat exchanger (22) varies depending on change in pressure of the high pressure refrigerant. Therefore, it will be an index of the pressure of the high pressure refrigerant. On the other hand, the temperature of the refrigerant in the liquid pipe (15) varies depending on change in pressure of the refrigerant in the liquid pipe (15). Therefore, it will be an index of the pressure of the refrigerant in the liquid pipe (15). Accordingly, pressure difference between the high pressure refrigerant and the refrigerant in the liquid pipe can be grasped by obtaining difference ΔT1 between the condensation temperature and the temperature of the refrigerant in the liquid pipe (15). In the concurrent operation, the expansion valve control means (17) adjusts the degree of opening of the outdoor expansion valve (23) so that the temperature difference ΔT1 becomes larger than a predetermined target value. This maintains the pressure difference between the high pressure refrigerant and the refrigerant in the liquid pipe, and prevents the above-described imbalance in refrigerant flow.

(Modified Example of Low-Pressure-Side Pressure Detection Means)

As a low-pressure-side pressure detection means which detects an index of pressure difference between the refrigerant in the liquid pipe and the low pressure refrigerant, the on-liquid-pipe temperature sensor (Ts8), and the first temperature sensor (Ts1), the third temperature sensor (Ts3), and the fifth temperature sensors (Ts5) provided on the indoor units (30, 40, 50) may be used. Specifically, in the above-described concurrent operation shown in FIG. 5, for example, the refrigerant reduced in pressure by the indoor expansion valves (42, 52) to become a low pressure refrigerant flows into the indoor heat exchangers (41, 51) of the second and third indoor units (40, 50) which perform cooling, respectively. In this case, evaporation temperature of the refrigerant in the second indoor heat exchanger (41) can be obtained by detecting the temperature of the refrigerant flowing into the second indoor heat exchanger (41) by the third temperature sensor (Ts3). Likewise, evaporation temperature of the refrigerant in the third indoor heat exchanger (51) can be obtained by detecting the temperature of the refrigerant flowing into the third indoor heat exchanger (51) by the fifth temperature sensor (Ts5). As described above, the first temperature sensor (Ts1), the third temperature sensor (Ts3), and the fifth temperature sensor (Ts5) constitute an evaporation temperature detection means which detects the evaporation temperature of the refrigerant in the heat exchanger serving as an evaporator in the concurrent operation. As the evaporation temperature detection means, the low-pressure-side pressure sensor (Ps2) described in Embodiments 1 and 2 may be used. Specifically, the evaporation temperature in the heat exchanger serving as an evaporator may be obtained by calculating saturation temperature corresponding to the pressure detected by the low-pressure-side pressure sensor (Ps2).

The evaporation temperature of the refrigerant in the indoor heat exchangers (41, 51) may vary depending on change in pressure of the low pressure refrigerant. Therefore, it will be an index of the pressure of the low pressure refrigerant. Accordingly, pressure difference between the refrigerant in the liquid pipe and the low pressure refrigerant can be grasped by obtaining difference ΔT2 between the temperature of the refrigerant in the liquid pipe (15) and the evaporation temperature. In the concurrent operation, the expansion valve control means (17) adjusts the degree of opening of the outdoor expansion valve (23) so that the temperature difference ΔT2 becomes larger than a predetermined target value. This maintains the pressure difference between the refrigerant in the liquid pipe and the low pressure refrigerant, and prevents the above-described imbalance in refrigerant flow.

(Modified Example Added with Subcooling Heat Exchanger)

Figure 10:
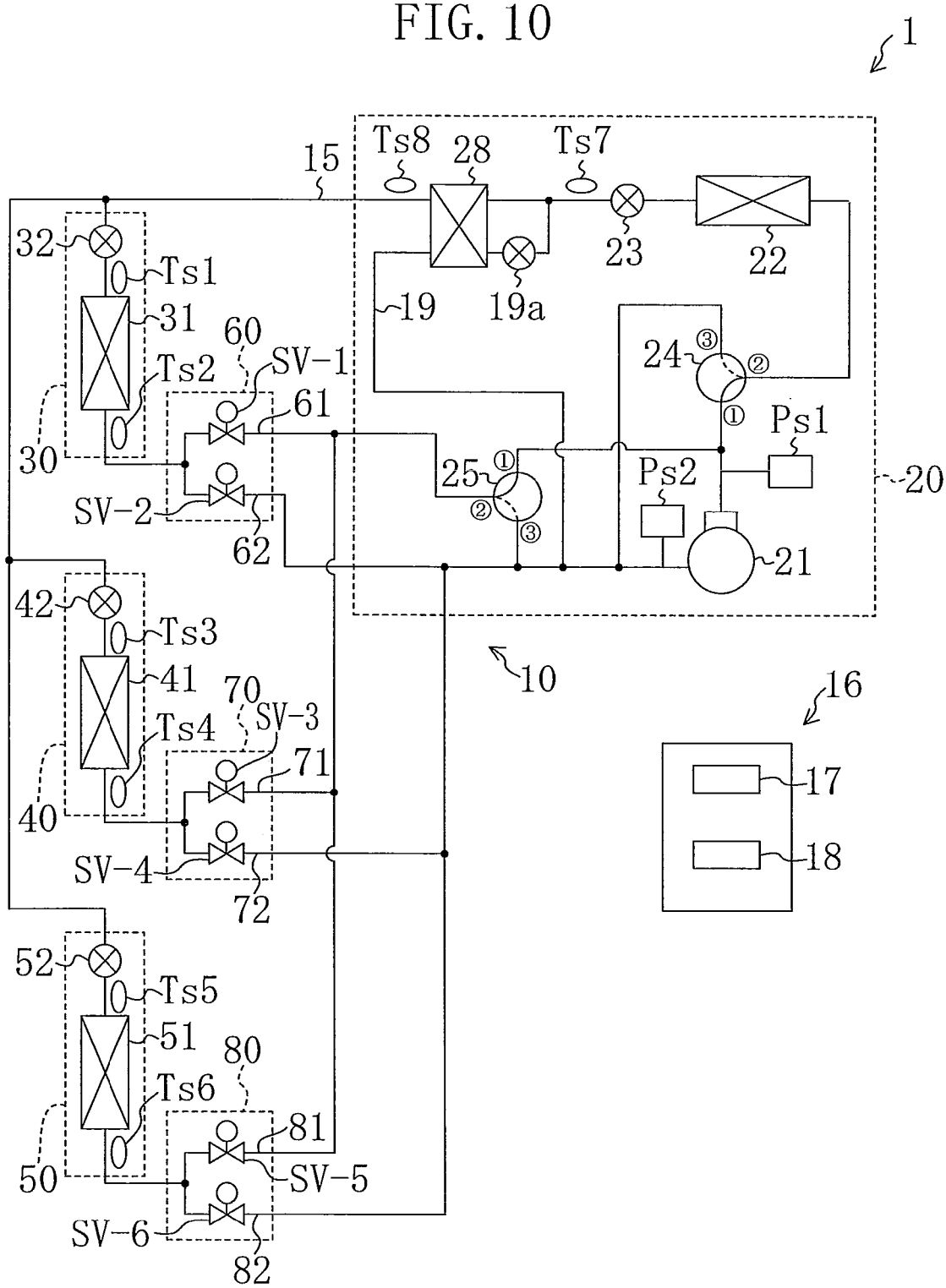
FIG. 10 is a piping diagram of a refrigerant circuit in a third modified example of the refrigeration system according to the embodiments of the present invention.

As shown in FIG. 10, a subcooling heat exchanger (28) may be added to the outdoor unit (20). In this example of the refrigerant circuit (10), an injection pipe (19) branched from the liquid pipe (15) and connected to the suction side of the compressor (21) is provided. The injection pipe (19) has a pressure reducing valve (19*a*), whose degree of opening is adjustable. The subcooling heat exchanger (28) is connected to both of the liquid pipe (15) and the injection pipe (19) downstream of the pressure reducing valve (19*a*). That is, the subcooling heat exchanger (28) allows, in the concurrent operation, heat exchange between the refrigerant in the liquid pipe (15) and the refrigerant in the injection pipe (19) after passing through the pressure reducing valve (19*a*). The subcooling heat exchanger (28) constitutes a cooling means which cools the refrigerant that passed through the outdoor expansion valve (23) in the concurrent operation. As the cooling means, other cooling means than that described in this modified example may be used.

The liquid pipe (15) is further provided with a first on-liquid-pipe temperature sensor (Ts7) provided on the inlet side of the subcooling heat exchanger (28) in the concurrent operation, and a second on-liquid-pipe temperature sensor (Ts8) provided on the outlet side of the subcooling heat exchanger (28). The on-liquid-pipe temperature sensors (Ts7, Ts8) constitute a temperature difference detection means which detects temperature difference between the refrigerant flowing into the subcooling heat exchanger (28) and the refrigerant flowing out of the subcooling heat exchanger (28). In this example, a controller (16) includes an injection amount control means (18) which adjusts the degree of opening of the pressure reducing valve (19*a*) so that the difference between the temperatures detected by the on-liquid-pipe temperature sensors (Ts7, Ts8) becomes larger than a predetermined value in the concurrent operation.

In the modified example of the air conditioner (1), the degree of opening of the pressure reducing valve (19*a*) is adjusted in the above-described concurrent operation so that the refrigerant flowing from the liquid pipe (15) to the low pressure side does not become a vapor-liquid two phase refrigerant. Specifically, in the concurrent operation shown in FIG. 4, for example, when the expansion valve control means (17) adjusts the degree of opening of the outdoor expansion valve (23) within a predetermined target range, the refrigerant reduced in pressure by the outdoor expansion valve (23) will be the vapor-liquid two phase refrigerant. Then, when the vapor-liquid two phase refrigerant flows into the third indoor unit (50) as it is, and passes through the third indoor expansion valve (52), it generates larger amount of noise as it passes through the expansion valve than a liquid-phase refrigerant. Therefore, in the concurrent operation in this modified example, the refrigerant flowing in the liquid pipe (15) is cooled in the subcooling heat exchanger (28) to prevent the noise generation.

Figure 11:
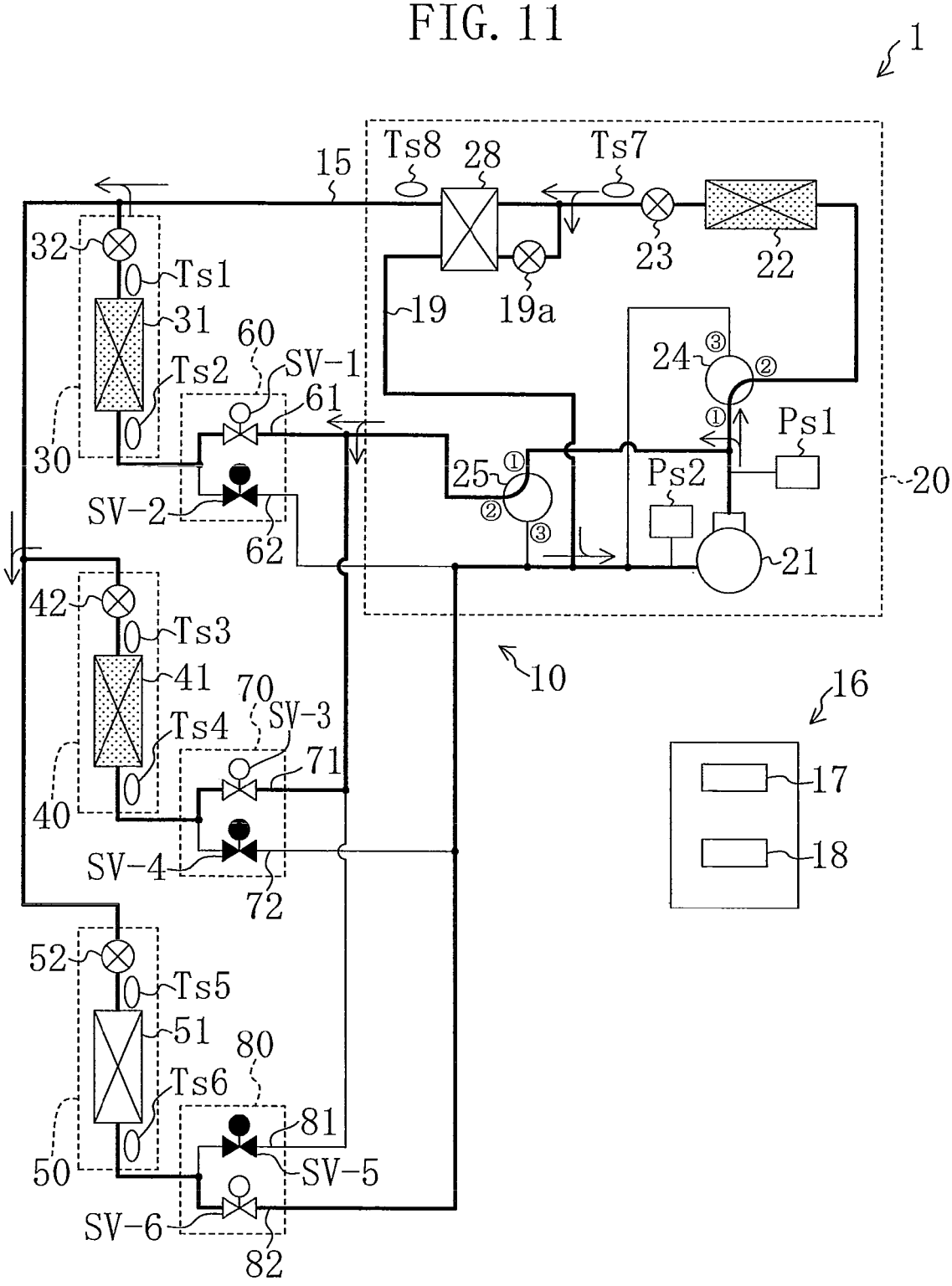
FIG. 11 is a piping diagram of the refrigerant circuit in the third modified example of the refrigeration system according to the embodiments of the present invention illustrating a refrigerant flow in concurrent operation.
Figure 12:
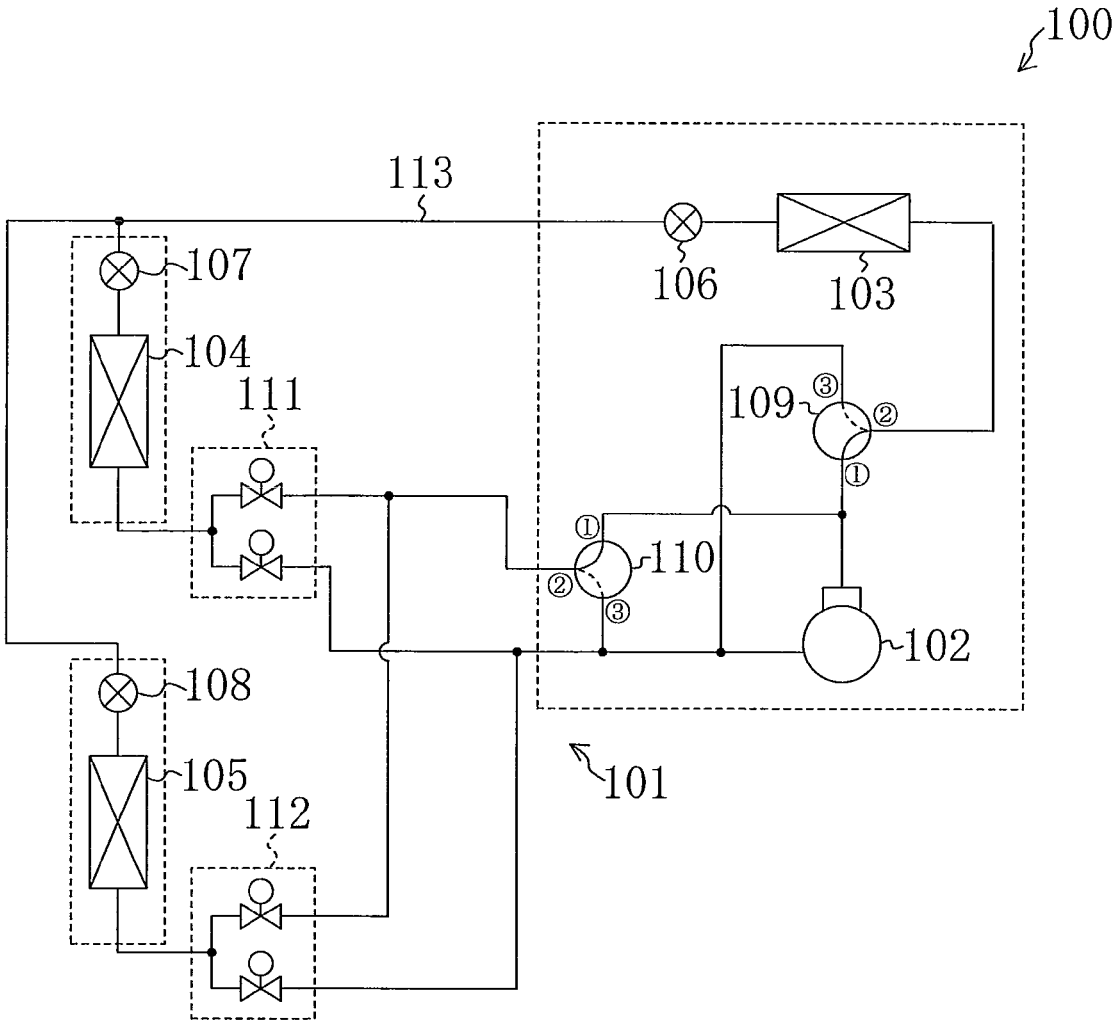
FIG. 12 is a piping diagram of a refrigerant circuit in a conventional refrigeration system.
Figure 13:
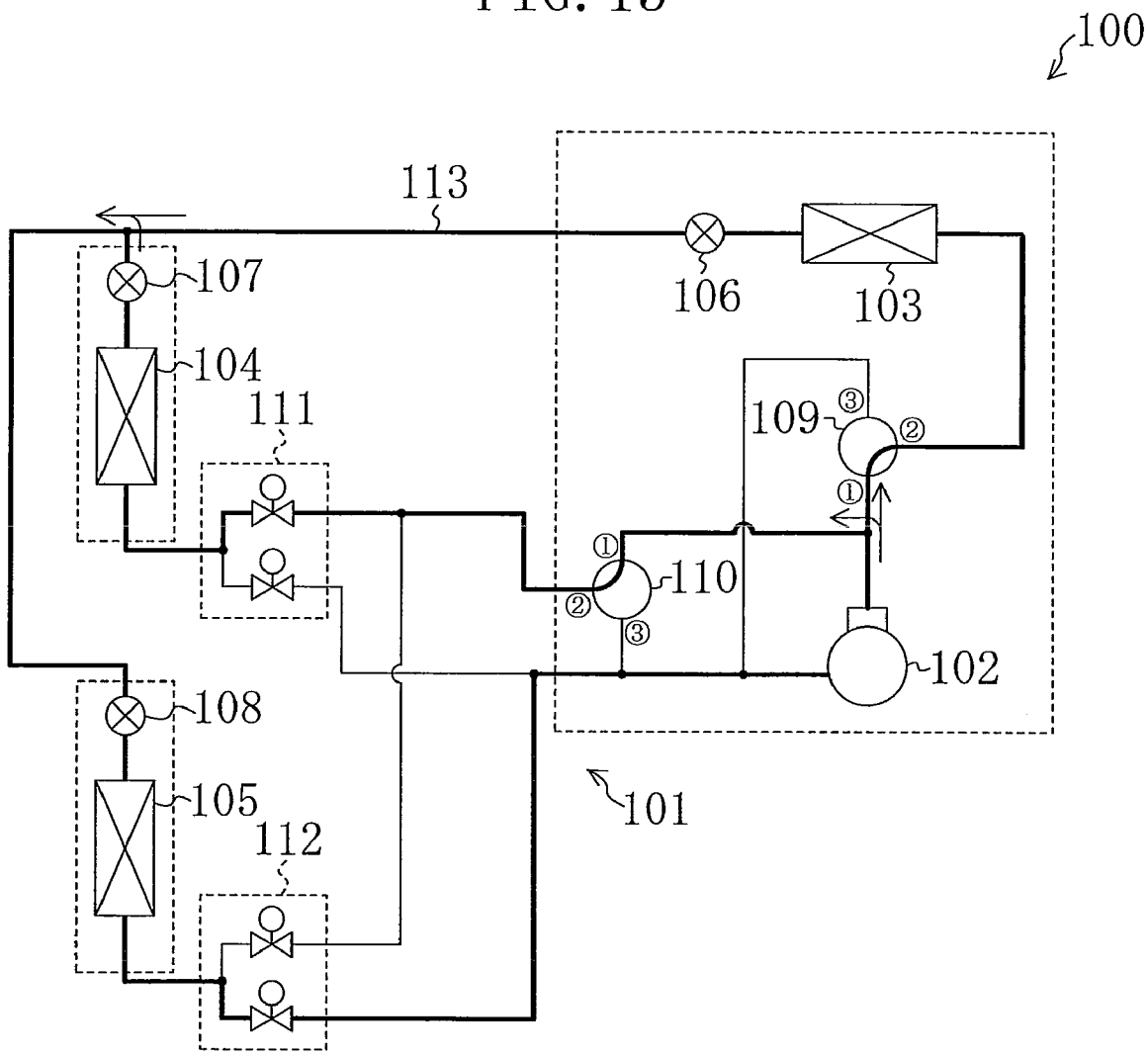
FIG. 13 is a piping diagram of the refrigerant circuit in the conventional refrigeration system illustrating a refrigerant flow in concurrent operation.

Specifically, referring to FIG. 11 illustrating the modified example applied to the same concurrent operation as that shown in FIG. 4, for example, the refrigerant condensed in the outdoor heat exchanger (22) and reduced in pressure by the outdoor expansion valve (23) becomes the vapor-liquid two phase refrigerant, and flows into the liquid pipe (15). Part of this refrigerant flows into the injection pipe (19). The refrigerant flowed into the injection pipe (19) is reduced in pressure by the pressure reducing valve (19*a*), and passes through the subcooling heat exchanger (28). In the subcooling heat exchanger (28), the vapor-liquid two phase refrigerant in the liquid pipe (15) and the low pressure refrigerant in the injection pipe (19) exchange heat. That is, in the subcooling heat exchanger (28), the refrigerant in the injection pipe (19) absorbs heat from the refrigerant in the liquid pipe (15) and evaporates. As a result, the refrigerant in the liquid pipe (15) is cooled. In this case, the degree of opening of the pressure reducing valve (19*a*) in the injection pipe (19) is adjusted so as to maintain the temperature difference between the refrigerant in the liquid pipe (15) before passing through the subcooling heat exchanger (28) and the refrigerant which passed through the subcooling heat exchanger (28), i.e., to maintain a predetermined degree of subcooling. Thus, in this modified example, the refrigerant in the liquid pipe (15) which passed through the subcooling heat exchanger (28) will reliably become a liquid refrigerant.

The liquid refrigerant thus obtained is sent to the low pressure third indoor unit (50). In the third indoor unit (50), the liquid refrigerant passes through the third indoor expansion valve (52). Therefore, noise generation by the refrigerant passing through the expansion valve is reduced as compared with the noise generation by the vapor-liquid two phase refrigerant.

Other Embodiments

The above-described embodiments and modified examples may be configured in the following manner.

The number of indoor units and outdoor units described in the above embodiments is indicated merely as an example. Therefore, the air conditioner may include a larger number of indoor and outdoor units.

INDUSTRIAL APPLICABILITY

As described above, the present invention relates to a refrigeration system including a refrigerant circuit having a plurality of heat exchangers, and is particularly useful as measures to cope with an imbalance in refrigerant flow between the heat exchangers.

The invention claimed is:

1. A refrigeration system comprising:

a refrigerant circuit including a compressor, a heat-source heat exchanger connected to a discharge side of the compressor at one end thereof, a liquid pipe connected to the other end of the heat-source heat exchanger through a heat-source expansion valve, a plurality of heat exchangers connected in parallel to the liquid pipe at one ends thereof, a plurality of expansion valves, each of which is provided on one end of the corresponding heat exchanger to adjust an amount of a refrigerant flowing to the corresponding heat exchanger, and a switching mechanism which switches a flow path of the refrigerant so that the other ends of the heat exchangers are connected to one of a suction side and a discharge side of the compressor, wherein the refrigeration circuit includes a high-pressure-side pressure difference detection unit which detects an index of pressure difference between a high pressure refrigerant on the discharge side of the compressor and a refrigerant in the liquid pipe in concurrent operation of performing a refrigeration cycle in which the heat-source heat exchanger functions as a condenser, and simultaneously, at least one of the plurality of heat exchangers functions as a condenser, and at least one of the plurality of heat exchangers functions as an evaporator, an expansion valve control unit which adjusts the degree of opening of the heat-source expansion valve in the concurrent operation so that a value detected by the high-pressure-side pressure difference detection unit becomes larger than a predetermined value, wherein the refrigerant circuit includes three or more heat exchangers connected in parallel to the liquid pipe, and a low-pressure-side pressure difference detection unit which detects an index of pressure difference between the refrigerant in the liquid pipe and a low pressure refrigerant on the suction side of the compressor, and the expansion valve control unit adjusts the degree of opening of the heat-source expansion valve so that a value detected by the high-pressure-side pressure difference detection unit becomes larger than a predetermined value, and a value detected by the low-pressure-side pressure difference detection unit becomes larger than a predetermined value, in the concurrent operation of performing a refrigeration cycle in which the heat-source heat exchanger functions as a condenser, and simultaneously, at least two of the plurality of heat exchangers function as evaporators, and at least one of the plurality of heat exchangers functions as a condenser.

2. The refrigeration system of claim 1, wherein the high-pressure-side pressure difference detection unit includes a high-pressure-side pressure sensor provided on the discharge side of the compressor, and an on-liquid-pipe pressure sensor provided on the liquid pipe, and the high-pressure-side pressure difference detection unit is configured to detect difference between pressure detected by the high-pressure-side pressure sensor and pressure detected by the on-liquid-pipe pressure sensor as the index of pressure difference between the high pressure refrigerant and the refrigerant in the liquid pipe.

3. The refrigeration system of claim 1, wherein the high-pressure-side pressure difference detection unit includes a condensation temperature detection unit which detects condensation temperature of the refrigerant in the heat-source heat exchanger in the concurrent operation, and an on-liquid-pipe temperature sensor provided on the liquid pipe, and the high-pressure-side pressure difference detection unit is configured to detect difference between temperature detected by the condensation temperature detection unit and temperature detected by the on-liquid-pipe temperature sensor as the index of pressure difference between the high pressure refrigerant and the refrigerant in the liquid pipe.

4. The refrigeration system of claim 1, wherein the liquid pipe is provided with a cooling unit which cools the refrigerant that passed through the heat-source expansion valve in the concurrent operation.

5. The refrigeration system of claim 4, wherein the refrigerant circuit includes an injection pipe, having a pressure reducing valve which is branched from the liquid pipe and connected to the suction side of the compressor, and temperature difference detection unit which detect temperature difference between the refrigerant flowing into the cooling unit and the refrigerant flowing out of the cooling unit, the cooling unit is constituted of a subcooling heat exchanger which allows heat exchange between the refrigerant in the liquid pipe and the refrigerant in the injection pipe that passed through the pressure reducing valve, and the refrigeration system includes an injection amount control unit which adjusts the degree of opening of the pressure reducing valve in the concurrent operation so that the refrigerant temperature difference detected by the temperature difference detection unit becomes larger than a predetermined value.

6. A refrigeration system comprising:

a refrigerant circuit including a compressor, a heat-source heat exchanger connected to a discharge side of the compressor at one end thereof, a liquid pipe connected to the other end of the heat-source heat exchanger through a heat-source expansion valve, a plurality of heat exchangers connected in parallel to the liquid pipe at one ends thereof, a plurality of expansion valves, each of which is provided on one end of the corresponding heat exchanger to adjust an amount of a refrigerant flowing to the corresponding heat exchanger, and a switching mechanism which switches a flow path of the refrigerant so that the other ends of the heat exchangers are connected to one of a suction side and a discharge side of the compressor, wherein the refrigeration circuit includes a high-pressure-side pressure difference detection unit which detects an index of pressure difference between a high pressure refrigerant on the discharge side of the compressor and a refrigerant in the liquid pipe in concurrent operation of performing a refrigeration cycle in which the heat-source heat exchanger functions as a condenser, and simultaneously, at least one of the plurality of heat exchangers functions as a condenser, and at least one of the plurality of heat exchangers functions as an evaporator, an expansion valve control unit which adjusts the degree of opening of the heat-source expansion valve in the concurrent operation so that a value detected by the high-pressure-side pressure difference detection unit becomes larger than a predetermined value, wherein the refrigerant circuit includes three or more heat exchangers connected in parallel to the liquid pipe, and a low-pressure-side pressure difference detection unit which detects an index of pressure difference between the refrigerant in the liquid pipe and a low pressure refrigerant on the suction side of the compressor, the expansion valve control unit adjusts the degree of opening of the heat-source expansion valve so that a value detected by the high-pressure-side pressure difference detection unit becomes larger than a predetermined value, and a value detected by the low-pressure-side pressure difference detection unit becomes larger than a predetermined value, in the concurrent operation of performing a refrigeration cycle in which the heat-source heat exchanger functions as a condenser, and simultaneously, at least two of the plurality of heat exchangers function as evaporators, and at least one of the plurality of heat exchangers functions as a condenser, the low-pressure-side pressure difference detection unit includes an on-liquid-pipe pressure sensor provided on the liquid pipe, and a low-pressure-side pressure sensor provided on the suction side of the compressor, and the low-pressure-side pressure difference detection unit is configured to detect difference between pressure detected by the on-liquid-pipe pressure sensor and pressure detected by the low-pressure-side pressure sensor as the index of pressure difference between the refrigerant in the liquid pipe and the low pressure refrigerant.

7. A refrigeration system comprising:

a refrigerant circuit including a compressor, a heat-source heat exchanger connected to a discharge side of the compressor at one end thereof, a liquid pipe connected to the other end of the heat-source heat exchanger through a heat-source expansion valve, a plurality of heat exchangers connected in parallel to the liquid pipe at one ends thereof, a plurality of expansion valves, each of which is provided on one end of the corresponding heat exchanger to adjust an amount of a refrigerant flowing to the corresponding heat exchanger, and a switching mechanism which switches a flow path of the refrigerant so that the other ends of the heat exchangers are connected to one of a suction side and a discharge side of the compressor, wherein the refrigeration circuit includes a high-pressure-side pressure difference detection unit which detects an index of pressure difference between a high pressure refrigerant on the discharge side of the compressor and a refrigerant in the liquid pipe in concurrent operation of performing a refrigeration cycle in which the heat-source heat exchanger functions as a condenser, and simultaneously, at least one of the plurality of heat exchangers functions as a condenser, and at least one of the plurality of heat exchangers functions as an evaporator, an expansion valve control unit which adjusts the degree of opening of the heat-source expansion valve in the concurrent operation so that a value detected by the high-pressure-side pressure difference detection unit becomes larger than a predetermined value, wherein the refrigerant circuit includes three or more heat exchangers connected in parallel to the liquid pipe, and a low-pressure-side pressure difference detection unit which detects an index of pressure difference between the refrigerant in the liquid pipe and a low pressure refrigerant on the suction side of the compressor, and the expansion valve control unit adjusts the degree of opening of the heat-source expansion valve so that a value detected by the high-pressure-side pressure difference detection unit becomes larger than a predetermined value, and a value detected by the low-pressure-side pressure difference detection unit becomes larger than a predetermined value, in the concurrent operation of performing a refrigeration cycle in which the heat-source heat exchanger functions as a condenser, and simultaneously, at least two of the plurality of heat exchangers function as evaporators, and at least one of the plurality of heat exchangers functions as a condenser, the low-pressure-side pressure difference detection unit includes an on-liquid-pipe temperature sensor provided on the liquid pipe, and an evaporation temperature detection unit which detects evaporation temperature of the refrigerant in the heat exchanger serving as an evaporator in the concurrent operation, and the low-pressure-side pressure difference detection unit is configured to detect difference between temperature detected by the on-liquid-pipe temperature sensor and temperature detected by the evaporation temperature detection unit as the index of pressure difference between the low pressure refrigerant and the refrigerant in the liquid pipe.

* * * * *